US006015647A

United States Patent [19]

Ugai et al.

[11] Patent Number: 6,015,647

[45] Date of Patent: Jan. 18, 2000

[54] TONER FOR DEVELOPING ELECTROSTATIC IMAGE AND IMAGE FORMING METHOD

[75] Inventors: Toshiyuki Ugai, Toride; Manabu Ohno, Numazu, both of Japan

[73] Assignee: Canon Kabushiki Kaisha, Tokyo, Japan

[21] Appl. No.: 09/289,944

[22] Filed: Apr. 13, 1999

[30] Foreign Application Priority Data

Apr. 14, 1998 [JP] Japan ..... 10-103166

[51] Int. Cl.[7] ..... G03G 9/097; G03G 13/22

[52] U.S. Cl. ..... 430/110; 430/111; 430/124

[58] Field of Search ..... 430/110, 111, 430/124

[56] References Cited

U.S. PATENT DOCUMENTS 5,605,778 2/1997 Onuma et al. ..... 430/111
5,635,325 6/1997 Inaba et al. ..... 430/110
5,707,771 1/1998 Matsunaga ..... 430/110
5,753,399 5/1998 Hayase et al. ..... 430/110
5,840,457 11/1998 Urawa et al. ..... 430/111
5,840,459 11/1998 Ohno et al. ..... 430/110

*Primary Examiner*—Roland Martin
*Attorney, Agent, or Firm*—Fitzpatrick, Cella, Harper & Scinto

[57] ABSTRACT

A toner for developing an electrostatic image is composed of toner particles containing at least a binder resin, a colorant and a wax composition. The wax composition comprises an ester wax (1) having a long-chain alkyl group, and a wax (2). The wax (2) shows a maximum heat-absorption peak in a range of 40–130° C. on temperature increase on a DSC (differential scanning calorimeter) curve, and gives a $^{13}$C-NMR (nuclear magnetic resonance) spectrum showing a total peak area S in a range of 0–50 ppm, a total peak area S1 in a range of 36–42 ppm, and a total peak area S2 in a range of 10–17 ppm, satisfying: $1.0 \leqq (S1/S) \times 100 \leqq 10$, $1.5 \leqq (S2/S) \times 100 \leqq 15$, and $S_1 < S_2$. The toner particles contain A wt. parts of the ester wax (1), B wt. parts of the wax (2) and C wt. parts of the colorant, respectively per 100 wt. parts of the binder resin, satisfying: $3 \leqq A \leqq 30$, $0.2 \leqq B \leqq 10$, $4 \leqq A+B \leqq 40$, $0.02 \leqq B/A \leqq 0.5$, and $0.02 \leqq B/C \leqq 2$.

38 Claims, 11 Drawing Sheets

TONER FOR DEVELOPING ELECTROSTATIC IMAGE AND IMAGE FORMING METHOD

FIELD OF THE INVENTION AND RELATED ART

The present invention relates to a toner for developing electrostatic images for use in electrophotography, and an image forming method using the toner.

Hitherto, a toner as a principal component of a developer for use in electrophotography has been generally produced through the pulverization process wherein starting materials inclusive of a binder resin, such as polyester resin, styrene-acrylate resin or epoxy resin, a colorant, and other additives, such as a charge control agent and a release agent, are melt-kneaded and uniformly dispersed with each other, followed by pulverization to prescribed particle sizes, and removal of excessively pulverized fine particles and coarse particles by means of a classifier to obtain a product toner (or toner particles).

For complying with a demand for further higher image quality in recent years, a toner comprising toner particles of a further smaller size has been required. However, when a small-particle size toner having a particle size as measured by a Coulter counter as small as 7 $\mu$m or smaller is produced through the above-mentioned pulverization process, there have been encountered difficulties in uniform dispersion of starting materials and effective pulverization, which have not been problematic heretofore. There has been also found a tendency that it become very difficult to obtain a sharp particle size distribution by classification for such a small-particle size toner.

For overcoming such difficulties involved in developer production through the pulverization process, developer production processes utilizing suspension polymerization have been proposed in Japanese Patent Publication (JP-B) 36-10231, JP-B 43-10799, JP-B 51-14895, etc.

In such a suspension polymerization process, a monomer composition comprising a polymerizable monomer, a colorant and a polymerization initiator, and further optionally a crosslinking agent, a charge control agent and other additives uniformly dissolved or dispersed with each other, is dispersed in a continuous phase, such as an aqueous phase, containing a dispersion stabilizer by an appropriate stirring means and is simultaneously subjected to polymerization to obtain toner particles of a desired particle size.

In the developer production process utilizing suspension polymerization, the toner material need not be provided with fragility because no pulverization step is involved, and can contain a low-softening point substance at a large quantity level which cannot be realized in the conventional pulverization process, so that the latitude for material selection can be broadened. Further, in the case of a toner produced through suspension polymerization, hydrophobic materials, such as a release agent and a colorant, are not readily exposed to toner particle surfaces, so that the resultant developer is less liable to soil the members of an image forming apparatus, such as a developer-carrying member, a photosensitive member, a transfer roller, and a fixing device. Thus, a remarkable attention is recently directed thereto.

Further, in recent years, digital full-color copying machines and printers have been commercialized, and a toner used in these apparatus is required to exhibit further improved performances in respects of faithful image reproducibility, releasability and color reproducibility. For example, in order to realize faithful image reproduction in a digital full-color copying machine, a larger amount of developer is required to be transferred from the photosensitive member to a transfer(-receiving) material, such as paper, than in a monochromatic copying machine, and a smaller particle size of developer is expected to be used so as to correspond to further minute dots as required in provision of further high image qualities in the future. In these respects, the polymerization process suited for producing minute toner particles having a sharp particle size distribution is regarded as an excellent process.

Incidentally, toner particles contain colorants of various pigments or dyes as an indispensable component, and many of these colorants are hygroscopic and therefore can cause a problem in performance stability in different environments. In order to provide an improvement to the problem, Japanese Laid-Open Patent Application (JP-A) 63-19663 has proposed spherical toner particles with a suppressed amount of carbon black exposed to the surface thereof, and JP-A 5-289396 has proposed full-color toner particles containing respective colorants of yellow, magenta and cyan while suppressing the surface exposure thereof by forming minute colorant-dispersed resinous domains dispersed in a thermoplastic matrix resin. According to these documents, it is possible to obtain a toner having a stable chargeability less depending on an environmental humidity by suppressing the exposure of hygroscopic colorants to toner particle surfaces.

However, the toner of JP-A 63-19663 provides insufficient image density (blackness), and the toner of JP-A 5-289396 provides an image density which is practically of no problem but is not necessarily excellent.

Further, JP-A 4-73662 has proposed a technique of enclosing electroconductivity-imparting carbon black, etc., within an insulating resin layer by forming a toner outer shell of such an insulating resin through a mechano-chemical reaction for the purpose of suppressing an edge effect of the resultant toner, which has however left room for improvements of blackness and gloss.

Further, in the case of toner production according to the conventional polymerization process, the following difficulties are liable to be encountered, particularly when carbon black is used as the colorant.

First, carbon black has on its surface a functional group, such as quinone group, inhibiting the polymerization of the polymerizable monomer, so that a monomer composition containing carbon black is cause to show a lower polymerization speed and is liable to form unstable particles causing agglomeration or coalescence at the time of particle formation due to insufficient polymerization, thus resulting in polymerizate particles which are difficult to recover.

Secondly, carbon black has a smaller primary particle size and a larger specific surface area than other pigments and also has a unique microtexture, so that its dispersion in the polymerizable monomer is very difficult, thus being liable to result in localization in each toner particle or toner particles failing to contain carbon black.

Thirdly, as carbon black has electroconductivity, the resultant toner is liable to cause surface charge leakage and difficulties, such as fog and toner scattering, at the time of development.

In order to obviate the above difficulties, for example, for solving the problem of polymerization inhibition, JP-A 56-116044 has proposed to use surface graft-treated carbon black, and JP-A 63-210849 has proposed to use carbon black surface-treated with an aluminum coupling agent. However, these proposals require a troublesome step of surface-treating carbon black, thus resulting in an increased production cost, so that the commercialization thereof is difficult.

Further, for solving the problem of dispersibility, JP-A 64-35457 and JP-A 1-145664 have proposed to use specific dispersion agents for improving the dispersibility, but a sufficient solution has not been attained.

SUMMARY OF THE INVENTION

A generic object of the present invention is to provide a toner for developing electrostatic images having solved the above-mentioned problems of the prior art.

A more specific object of the present invention is to provide a toner for developing electrostatic images having a sufficient coloring power, retaining good chargeability in various environments and capable of stably providing high-definition and high-quality images.

Another object of the present invention is to provide a toner for developing electrostatic images exhibiting excellent low-temperature fixability and good transferability or transfer efficiency.

Another object of the present invention is to provide a toner for developing electrostatic images capable of effectively preventing high-temperature offset without applying a release agent such as oil onto a fixing roller.

A further object of the present invention is to provide an image forming method using a toner as described above.

According to the present invention, there is provided a toner for developing an electrostatic image, comprising toner particles containing at least a binder resin, a colorant and a wax composition;

wherein the wax composition comprises an ester wax (1) having a long-chain alkyl group, and a wax (2); said wax (2) showing a maximum heat-absorption peak in a range of 40–130° C. on temperature increase on a DSC (differential scanning calorimeter) curve, and giving a $^{13}$C-NMR (nuclear magnetic resonance) spectrum showing a total peak area S in a range of 0–50 ppm, a total peak area S1 in a range of 36–42 ppm, and a total peak area S2 in a range of 10–17 ppm, satisfying:

$1.0 \leqq (S1/S) \times 100 \leqq 10$, $1.5 \leqq (S2/S) \times 100 \leqq 15$, and $S_1 < S_2$, and the toner particles contain A wt. parts of the ester wax (1), B wt. parts of the wax (2) and C wt. parts of the colorant, respectively per 100 wt. parts of the binder resin, satisfying:

$3 \leqq A \leqq 30$, $0.2 \leqq B \leqq 10$, $4 \leqq A+B \leqq 40$, $0.02 \leqq B/A \leqq 0.5$, and $0.02 \leqq B/C \leqq 2$.

According to another aspect of the present invention, there is provided an image forming method, comprising:

a charging step of charging an image-bearing member, an electrostatic image-forming step of forming an electrostatic image on the charged image-bearing member, a developing step of developing the electrostatic image with the above-mentioned toner carried on a developer-carrying member to form a toner image on the image-bearing member;

a transfer step of transferring the toner image on the image-bearing member onto a transfer-receiving material via or without via an intermediate transfer member, and a fixing step of fixing the toner image on the transfer-receiving material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
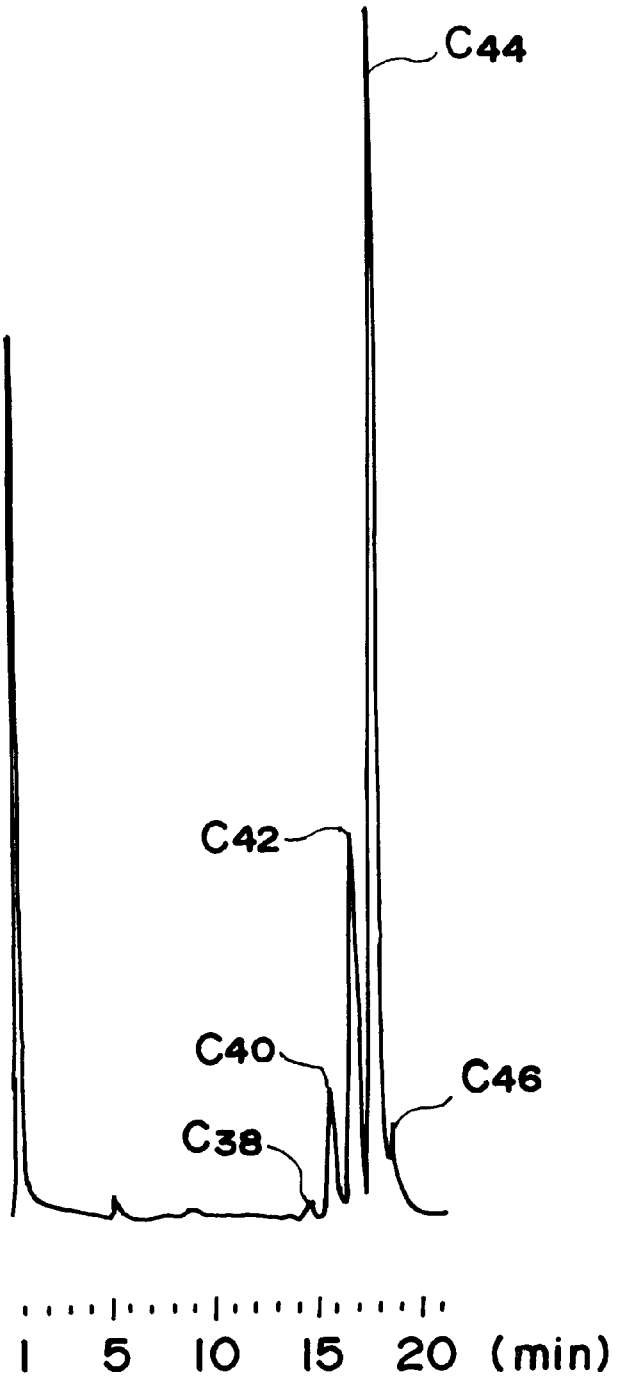
FIG. 1 is an example of gas chromatogram for an ester wax.

As a result of our study for solving the above-mentioned problems of the prior art, it has been found possible to suppress a lowering in chargeability attributable to electroconductivity of a colorant and provide a toner capable of exhibiting good transferability and fixability and providing high-definition and high-quality images for a long period by incorporating an ester wax (hereinafter sometimes referred to as "ester wax (1)") and a wax characterized by specific properties (hereinafter referred to as "wax (2)" in specific proportions in the toner.

More specifically, the wax (2) effective for improving the toner is first characterized by giving a $^{13}$C-NMR (nuclear magnetic resonance) spectrum showing a total peak area S in a range of 0–50 ppm, a total peak area S1 in a range of 36–42 ppm, and a total peak area S2 in a range of 10–17 ppm, satisfying:

$1.0 \leqq (S1/S) \times 100 \leqq 10$, $1.5 \leqq (S2/S) \times 100 \leqq 15$, and $S_1 < S_2$.

The toner chargeability-improving effect attained by inclusion of the wax (2) is particularly noticeable in a high humidity environment, whereby it becomes possible to obtain a sufficient chargeability and prevent the lowering in chargeability due to standing for a long period. The reason for this has not been fully clarified as yet, but we consider it attributable to suppression of charge leakage due to improved dispersion of the colorant.

As a result of further study in a two-component developer including a toner and a carrier, the addition of the wax (2) alone is not effective for providing a sufficient toner flowability, thus failing to sufficiently take the toner into the carrier to cause toner blowing or fog in a high humidity environment. Further, in a low humidity environment, a roughening of halftone portion has been found to occur. However, as a result of further study, this problem is found to be solved by the co-use of the ester wax (1) having a long-chain alkyl group in a specific proportion in addition to the wax (2) to provide further better performances, whereby the present invention has been accomplished.

According to our study from another aspect, it has been found that the addition of an ester wax in toner production by the suspension polymerization process provides a better toner flowability than other waxes but the addition of an ester wax alone has caused a lowering of chargeability sometimes in a high humidity environment due to charge leakage, especially when carbon black is used as the colorant. Further, compared with a good flowability, the toner transferability is not so good, thus being liable to fail in providing sufficiently high-definition images, particularly in a low humidity environment.

However, it has been found that if the ester wax (1) and the wax (2) are added in combination to be co-present in a toner, the above-mentioned problems can be solved respectively to further provide a good transferability. The reason has not been clarified yet but may be attributable to an improved dispersion of a colorant in the toner due to the co-addition of the ester wax (1) and the wax (2), whereby the amount of the colorant present at the toner surface is reduced to suppress the transfer current leakage along the toner surface, thereby improving the transferability.

According to our further study, the above-mentioned improvements can be ensured if the contents of the ester wax (1), the wax (2) and the colorant in the toner are controlled within proper ranges, i.e., the toner particles contain A wt. parts of the ester wax (1), B wt. parts of the wax (2) and C wt. parts of the colorant, respectively per 100 wt. parts of the binder resin, satisfying:

$3 \leqq A \leqq 30$, $0.2 \leqq B \leqq 10$, $4 \leqq A+B \leqq 40$, $0.02 \leqq B/A \leqq 0.5$, and $0.02 \leqq B/C \leqq 2$.

First of all, the content of the ester wax (1) is set to be 3–30 wt. parts per 100 wt. parts of the binder resin. Below 3 wt. parts, the objective improvement in flowability cannot be obtained nor can be obtained good fixability. On the other hand, if the content of the ester wax (1) exceeds 30 wt. parts, toner particles obtained through the direct polymerization process are liable to coalesce with each other, and isolated wax particles are liable to occur, thus soiling the developer-carrying member, etc.

The content of the wax (2) is set to be 0.2–10 wt. parts per 100 wt. parts of the binder resin. Below 0.2 wt. part, the chargeability-improving effect cannot be sufficiently attained, and in excess of 10 wt. parts, the flowability of a toner in a two-component developer is liable to become insufficient, thus causing toner scattering or fog in a high humidity environment.

Further, the total content (A+B) of the ester wax (1) and the wax (2) is set to be 4–40 wt. parts per 100 wt. parts of the binder resin. Below 4 wt. parts, it is difficult to ensure a good fixability, and above 40 wt. parts, the probability of presence of isolated wax particles is increased to soil the developer-carrying member, etc.

The content ratio (B/A) between the wax (2) and the ester wax (1) is set to be 0.02–0.5. Accordingly to our study, if the ratio (B/A) is below 0.02, the toner chargeability improvement effect cannot be sufficiently attained, and above 0.5, the flowability improvement cannot be sufficiently ensured.

Further, the content ratio (B/C) between the wax (2) and the colorant is set to be 0.02–2. If the ratio (B/C) is below 0.02, a sufficient colorant dispersion cannot be achieved to fail in improvement of the chargeability, and above 2, the dispersibility is rather hindered, thus being liable to result in a worse chargeability.

Now, the ester wax (1) and the wax (2) contained in specific proportions as described above in the toner according to the present invention will be described respectively in further detail.

The ester wax (1) is characterized as an ester compound having a long-chain alkyl group and may suitably comprise an ester compound represented by the following formula:

$$R_1—COO—R_2,$$

wherein $R_1$ and $R_2$ independently denote a hydrocarbon group of 15–45 carbon atoms.

It is further preferred that the ester wax (1) comprises a wax composition containing ester compounds of the above formula in such a proportion that ester compounds having an identical number of total carbon atoms occupy 50–95 wt. % of the wax composition.

The content of the ester compounds having an identical number of total carbon atoms may be measured by gas chromatography (GC) and the values described herein are based on those measured according to the following method by using an apparatus "GC-17A", available from Shimazu Seisakusho K.K.

A sample is preliminarily dissolved in toluene at a concentration of 1 wt. %, and 1 $\mu$l of the solution is injected into the apparatus equipped with an on-column injector. The column used is Ultra Alloy-1 (HT) having sizes of 0.5 mm-dia.×10 m-length. The column is initially heated at a rate of 40° C./min. from 40° C. to 200° C., then at a rate of 15° C./min. to 350° C., and then at a rate of 7° C./min. to 450° C. He (helium) gas is caused to flow as a carrier gas at a pressure of 50 kPa. The ester compounds are identified by comparison with chromatograms of alkanes having a known number of carbon atoms prepared in advance by the same apparatus and the results of mass spectrum chromatography of the gassified components thereof. The content of an ester compound is calculated as a ratio of the peak area thereof to a total area of peaks in a chromatogram of the sample wax.

An example of gas chromatogram of an ester wax is shown in FIG. 1. FIG. 1 shows that the ester wax contains:

1) ca. 0.6 wt. % of ester compounds having totally 38 carbon atoms and represented by $CH_3—(CH_2)_{18}—COO—(CH_2)_{17}—CH_3$, and $CH_3—(CH_2)_{16}—COO—(CH_2)_{17}—CH_3$, 2) ca. 5.8 wt. % of ester compounds having totally 40 carbon atoms and represented by $CH_3—(CH_2)_{18}—COO—(CH_2)_{19}—CH_3$, $CH_3—(CH_2)_{20}—coo—(CH_2)_{17}—CH_3$, and $CH_3—(CH_2)_{16}—COO—(CH_2)_{21}—CH_3$, 3) ca. 19.0 wt. % of ester compounds having totally 42 carbon atoms and represented by $CH_3—(CH_2)_{22}—COO—(CH_2)_{17}—CH_3$, $CH_3$—$(CH_2)_{18}$—COO—$(CH_2)_{21}$—$CH_3$, and $CH_3$—$(CH_2)_{20}$—COO—$(CH_2)_{19}$—$CH_3$, 4) ca. 72.9 wt. % of ester compounds having totally 44 carbon atoms and represented by $CH_3$—$(CH_2)_{22}$—COO—$(CH_2)_{19}$—$CH_3$, $CH_3$—$(CH_2)_{20}$—COO—$(CH_2)_{21}$—$CH_3$, and 5) ca. 1.7 wt. % of an ester compound having totally 46 carbon atoms and represented by $CH_3$—$(CH_2)_{22}$—COO—$(CH_2)_{21}$—$CH_3$.

Incidentally, the sample ester wax used in the above-measurement was confirmed to contain, as a principal constituent, ca. 72.6 wt. % of an ester compound having totally 44 carbon atoms and represented by $CH_3$—$(CH_2)_{20}$—COO—$(CH_2)_{21}$—$CH_3$.

The ester wax (1) particularly preferably used in the present invention is generally synthesized from a higher alcohol component and a higher carboxylic acid component. The higher alcohol and higher carboxylic acid components have been obtained from a natural product in many cases and generally composed of a mixture of components having even numbers of carbon atoms. When the mixture is esterified as it is, the resultant esterified product is caused to contain, in addition to an objective ester compound, various by-products of analogous structures, which are liable to adversely affect the various performances of the resultant toner. For this reason, the ester wax (1) used in the present invention may preferably be obtained through purification of starting materials and product by solvent extraction or distillation under a reduced pressure.

In case where the content of the ester compounds having an identical number of carbon atoms is below 50 wt. %, a complicated variety of crystal forms and a lowering in solidifying point are liable to cause an adverse effect to principally the anti-blocking characteristic and developing performance of the toner. More specifically, in the mono-component developing system, the toner melt-sticking is liable to occur on the developing sleeve, thus being liable to result in a streak-like image defects in the resultant images extending in a circumferential direction of the sleeve. Also in the two-component developing system, filming attributable to the wax is liable to occur on the carrier particles or the photosensitive member surface, thus causing a lowering in toner triboelectric charge and failing to continuously provide a sufficient triboelectric charge.

The ester compounds having an identical number of total carbon atoms may preferably constitute 55–95 wt. %, further preferably 60–95 wt. %, of the ester wax (1) used in the present invention. It is further preferred that ester compounds having a number of carbon atoms in a range of the above-mentioned identical number (the number of carbon atoms in a principal ester compound) ±2 occupy 80–95 wt. %, more preferably 90–95 wt. %, of the ester wax.

It is particularly preferred that ester compounds represented by $R_1'$—COO—$R_2'$ (wherein $R_1'$ and $R_2'$ independently denote a hydrocarbon group having 15–45 carbon atoms) and having totally 44 carbon atoms occupy 50–95 wt. % of the ester wax (1).

Among the ester compounds constituting the ester wax and represented by $R_1$—COO—$R_2$, those including the group $R_1$ and/or $R_2$ which are saturated hydrocarbon groups, particularly linear alkyl groups, are preferred. It is particularly preferred to use ester compounds including a group $R_1$ of a linear alkyl having 15–45 carbon atoms and a group $R_2$ of a linear alkyl having 16–44 carbon atoms. Preferred examples of the ester compounds may include those represented by the following formulae:

| | Toner number of C |
|---|---|
| $CH_3$—$(CH_2)_{16}$COO—$(CH_2)_{17}CH_3$ | 36 |
| $CH_3$—$(CH_2)_{18}$COO—$(CH_2)_{17}CH_3$ | 38 |
| $CH_3$—$(CH_2)_{16}$COO—$(CH_2)_{19}CH_3$ | 38 |
| $CH_3$—$(CH_2)_{18}$COO—$(CH_2)_{19}CH_3$ | 40 |
| $CH_3$—$(CH_2)_{20}$COO—$(CH_2)_{17}CH_3$ | 40 |
| $CH_3$—$(CH_2)_{16}$COO—$(CH_2)_{21}CH_3$ | 40 |
| $CH_3$—$(CH_2)_{22}$COO—$(CH_2)_{17}CH_3$ | 42 |
| $CH_3$—$(CH_2)_{18}$COO—$(CH_2)_{21}CH_3$ | 42 |
| $CH_3$—$(CH_2)_{20}$COO—$(CH_2)_{19}CH_3$ | 42 |
| $CH_3$—$(CH_2)_{22}$COO—$(CH_2)_{19}CH_3$ | 44 |
| $CH_3$—$(CH_2)_{20}$COO—$(CH_2)_{21}CH_3$ | 44 |
| $CH_3$—$(CH_2)_{22}$COO—$(CH_2)_{21}CH_3$ | 46 |
| $CH_3$—$(CH_2)_{27}$COO—$(CH_2)_{20}CH_3$ | 50 |
| $CH_3$—$(CH_2)_{14}$COO—$(CH_2)_{43}CH_3$ | 60 |
| $CH_3$—$(CH_2)_{43}$COO—$(CH_2)_{22}CH_3$ | 68 |

The ester wax (1) used in the present invention may preferably show a main peak temperature on a heat-absorption curve obtained according to ASTM D3418-8 (hereinafter called "melting point") of 40–90° C., more preferably 55–85° C., in view of the low-temperature fixability and anti-offset characteristic of the resultant toner.

An ester wax having a melting point of below 40° C. is liable to show a weak self-cohesion, thus resulting in an inferior anti-high-temperature offset characteristic. On the other hand, an ester wax showing a melting point exceeding 90° C. is liable to require a high fixing temperature, thus making it difficult to appropriately smoothen the fixed image surface and resulting in a lower color-mixing characteristic. Further, in the case of producing toner particles through direct polymerization including particle formation and polymerization in an aqueous medium, an ester wax having a high melting point is liable to cause precipitation and making it difficult to provide a sharp particle size distribution.

The melting point measurement according to ASTM D3418-8 may be performed by using a differential scanning calorimeter (e.g., "DSC-7" available from Perkin Elmer Co.). The temperature correction of the detector may be performed by using the melting points of indium and zinc, and the heat capacity correction may be performed by using the heat of fusion of indium. A sample is placed in an aluminum pan and a blank pan is set for a reference purpose. The measurement may be performed at a temperature raising rate of 10° C./min.

The ester wax (1) used in the present invention may preferably have a hardness of 0.5–5.0. The hardness mentioned herein refers to a Vickers hardness of a sample ester wax shaped into a cylindrical pellet of 20 mm in diameter and 5 mm in thickness as measured by a dynamic ultra-minute hardness meter ("DUH-200" available from Simazu Seisakusho K.K.). The measurement may be made under a load of 0.5 g and a loading speed of 9.67 mm/sec to cause a displacement of 10 $\mu$m, followed by holding for 15 sec., to measure the shape of the resultant cavity to measure a Vickers hardness.

An ester wax having a hardness of below 0.5 is liable to show a fixing performance which shows a large dependence on a fixing pressure and a process speed, thus being liable to provide an inferior anti-high-temperature offset characteristic. On the other hand, a hardness in excess of 5.0 leads to a lower storage stability of a toner and a low self-cohesion of the ester wax per se, thus being liable to provide a low anti-high-temperature offset characteristic.

The ester wax (1) may preferably have a weight-average molecular weight (Mw) of 200–2000, more preferably 300–1000, and a number-average molecular weight (Mn) of 150–2000, more preferably 250–1000. In case where Mw is below 200 and Mn is below 150, the resultant toner is liable to have a lower anti-blocking characteristic. In case where Mw exceeds 2000 and Mn exceeds 2000, the particle-forming characteristic during toner production is liable to be imparted, and the resultant toner particles are liable to coalesce with each other.

The molecular weight distribution of wax may be obtained based on measurement by GPC (gel permeation chromatography), e.g., under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The wax (2) used in the present invention together with the ester wax (1) described above is one providing a DSC curve obtained by using a DSC (differential scanning calorimeter) showing a maximum heat-absorption peak temperature (hereinafter called a "melting point") in a temperature region of 40–130° C. in the course of temperature increase. By having a melting point in the above-mentioned temperature range, the wax (2) exhibits an effective release effect while contributing to low-temperature fixation. If the melting point appears at a temperature below 40° C., the wax shows only weak self-cohesion to result in a lowering in anti-high-temperature offset characteristic and an excessively high gloss of fixed image. On the other hand, if the melting point exceeds 130° C., the toner is caused to show a high fixation temperature, and in the case of toner production through direct polymerization in an aqueous system, the wax is liable to precipitate during particle formation.

The melting point values of the wax (2) described herein are values measured according to ASTM D3418-8 (by using "DSC-7" available from Perkin Elmer Corp.) similarly as those of the ester wax (1).

Figure 3:
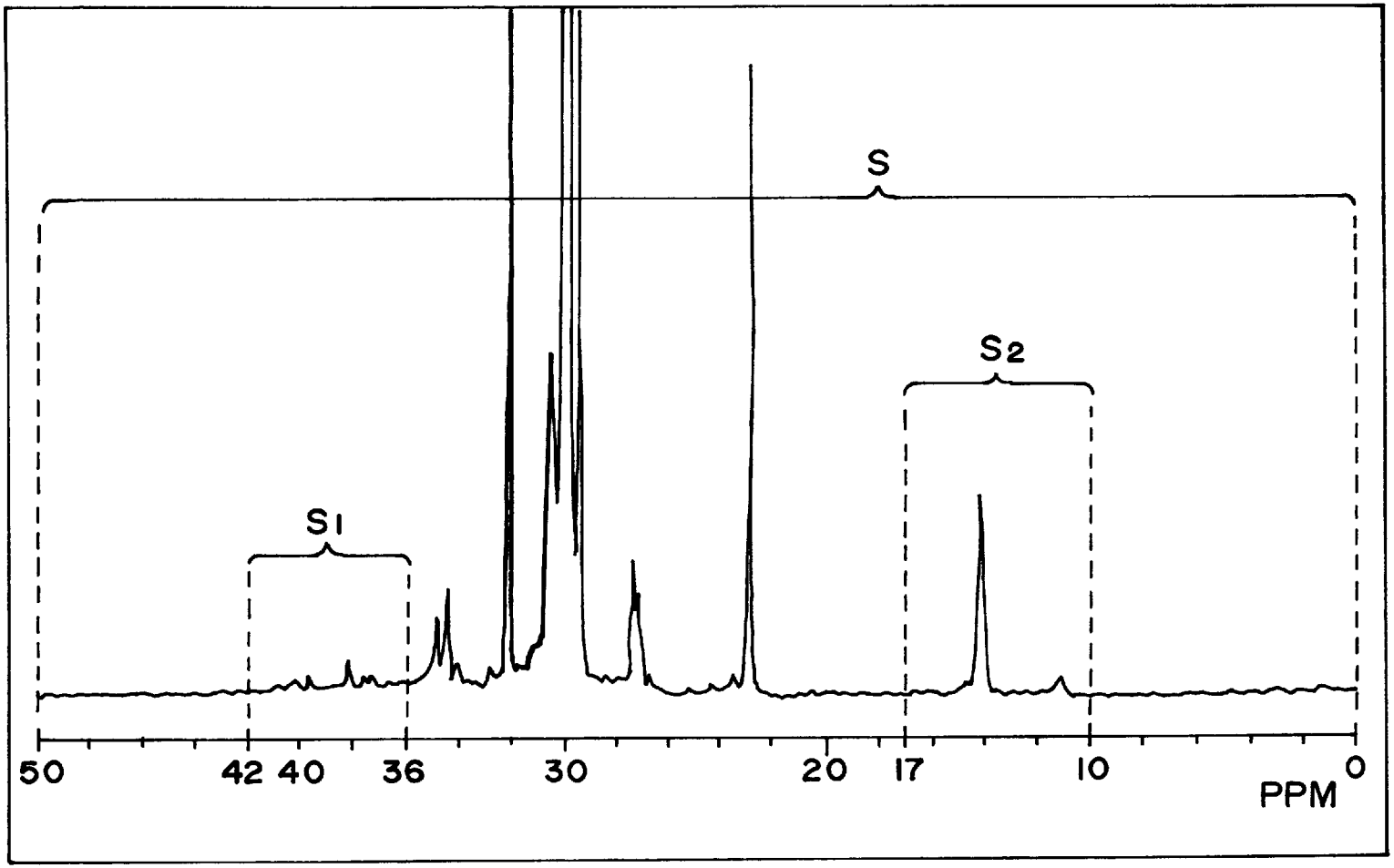
FIG. 3 is an example of $^{13}$C-NMR spectrum of a wax (2).

FIG. 3 shows a $^{13}$C-NMR (nuclear magnetic resonance) spectrum of a wax (2) suitably used in the present invention. With reference to FIG. 3, the wax (2) suitably used in the present invention is one giving a $^{13}$C-NMR (nuclear magnetic resonance) spectrum showing a total peak area S in a range of 0–50 ppm, a total peak area S1 in a range of 36–42 ppm and a total peak area S2 in a range of 10–17 ppm satisfying the following formulae:

$$1.0 \leqq (S1/S) \times 100 \leqq 10,$$

$$1.5 \leqq (S2/S) \times 100 \leqq 15,$$

and $$S1 < S2.$$

S1 is attributable to tertiary and quaternary carbon atoms in the wax molecules, so that S1 represents the presence of a branched structure and not that the wax is composed of a simple linear polymethylene. S2 is attributable to primary carbon atoms of methyl groups at the terminals of main chains and branched chains of wax molecules.

According to our study, if a toner is produced by using a wax (2) having a branch density and a branched state so as to satisfy the above conditions, the dispersion of a colorant, particularly that of carbon black, is effectively improved to provide a further improved chargeability in a high humidity environment.

It is further preferred, the wax (2) has a [(S1/S)×100] value of 1.5–8.0 and a [(S2/S)×100] value of 2.0–13.0, particularly preferably a [(S1/S)×100] value of 2.0–6.0 and a [(S2/S)×100] value of 3.0–10.0.

If the wax (2) has an adequately branched long-chain structure as to satisfy the condition of $S_1 < S_2$, a toner containing the wax may be provided with improved low-temperature fixability and anti-high-temperature offset characteristic. Further, as an adequate degree of shearing force can be applied to a composition for providing a toner during a melt-kneading step for the toner production, the dispersion of the respective toner ingredients can be dispersed to provide an improved developing performance. On the other hand, in the case of toner production by direct polymerization wherein it is generally difficult to apply a shearing force, the wax is melted under heating in a monomer condition to provide the monomer composition with an increased solution viscosity which is desirable for uniform dispersion of the respective toner additives, such as a colorant, and suitable for particle formation in a suspension form to provide a polymerization toner with an improved particle size distribution and improved dot reproducibility.

The electrophotographic performance improvement effect of the wax (2) is further enhanced if the wax (2) is rich in branched structure as to provide a $^{13}$C-NMR spectrums showing plural peaks in the range of 10–17 ppm. Hitherto, the use of a wax having a developed branch structure has resulted in several difficulties attributable to dispersibility thereof, such difficulties can be obviated by controlling the density and state of branches as described above.

The parameters characterizing the wax (2) used in the present invention described herein and based on $^{13}$C-NMR spectroscopy performed by using an FT-NMR (Fourier transform-nuclear magnetic resonance) apparatus ("JNM-EX400", available from Nippon Denshi K.K.) under the following conditions.

Measurement frequency: 100.40 MHz

Pulse condition: 5.0 μsec (45 deg.) according to the DEPT method

Data point: 32768

Delay time: 25 sec.

Frequency range: 10500 Hz

Integration times: 10000 times

Temperature: 110° C.

A sample solution is prepared by placing 200 mg of a measurement sample in a 10 mm-dia. sample tube and dissolving it by adding a mixture solvent of benzene-$d_6$/o-dichlorobenzene-$d_4$ (1/4) in a thermostat vessel at 110° C.

The wax (2) used in the present invention may be example be obtained from low-molecular weight polyalkylenes formed by subjecting an alkylene to radical polymerization under high temperature and high pressure or polymerization in the presence of Ziegler catalyst, and by-products thereof; low-molecular weight polyalkylene formed by thermally decomposing high-molecular weight polyalkylene; and low-molecular weight polyalkylene obtained by oxidizing high-molecular weight polyalkylene.

It is also possible to preferably use a fractionated wax formed by fractionating the above-mentioned waxes, e.g., by press sweating, solvent process, vacuum distillation, supercritical gas extraction, fractional crystallization (e.g., multi-crystallization and crystal filtration), etc. It is also possible to effect oxidation, block-copolymerization or modification by grafting. It is also possible to provide an arbitrary molecular weight distribution, e.g., by removal of a low-molecular weight fraction, or extraction of a low-molecular weight fraction, optionally followed further by removal of a low-molecular weight fraction therefrom.

The wax (2) used in the present invention may preferably have a weight-average molecular weight (Mw) of 600–50,000, more preferably 800–40,000, further preferably 1,000–30,000. It is further preferred that the wax (2) has a number-average molecular weight (Mn) of 400–4,000, more preferably 450–3,500, and the wax (2) has an Mw/Mn ratio of 3.5–30, more preferably 4–25.

The wax (2) used in the present invention may for example be a wax comprising hydrocarbon compounds having a branched long-chain structure as represented by the following formula:

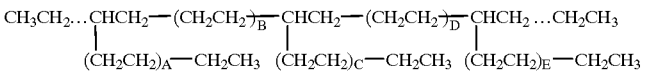

wherein A, C and E respectively denote a positive number of at least 1, and B and D denote 0 or a positive number of at least 1. The respective branches including a number (e.g., A, C, E . . . ) of ethylene groups can be further branched into short branches. Such a wax may be prepared by copolymerizing an α-monodefinic hydrocarbon as represented by

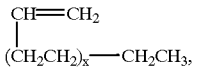

wherein x is an integer of at least 1, with ethylene. It is preferred that the a-monoolefinic hydrocarbon is a mixture of species having different values of x, and an average of x may preferably be in the range of 5–30 so as to provide a toner with further improved low-temperature fixability and anti-high-temperature offset characteristic.

The reason for the colorant dispersion-improving effect attained by the use of the wax (2) has not been fully clarified yet, but it is considered according to our study that the wax (2) is provided with an adequate degree of affinity with the colorant if the branch density and branch chain state are controlled to satisfy the above conditions, thereby improving the dispersion of the colorant. As a result, it is assumed that the amount of the colorant at the toner surface can be reduced to prevent the charge leakage. Such an improvement is particularly noticeable when carbon black is used as the colorant.

The ester wax (1) and the wax (2) used in the present invention may preferably have melting points $MP_1$ and $MP_2$, respectively satisfying a relationship of $-20 \leqq MP_2 - MP_1 \leqq 30$. If this relationship is satisfied, the miscibility between the waxes is improved to provide the toner with an improved flowability, thereby providing further improved developing performances. Further, as the soiling of the developer-carrying member and the carrier is suppressed, the toner can exhibited further improvements in continuous image forming performance and matching with the image forming apparatus.

The toner for developing electrostatic images containing the above-mentioned specific waxes in specific amounts, may preferably have a shape factor SF-1 of 100–160 and a shape factor SF-2 of 100–140, more preferably SF-1 of 100–140 and SF-2 of 100–120, based on analysis by an image analyzer.

The shape factors SF-1 and SF-2 referred to herein are based on values measured in the following manner. Sample particles are observed through a field-emission scanning electron microscope ("FE-SEM S-800", available from Hitachi Seisakusho K.K.) at a magnification of 500, and 100 images of toner particles having a particle size (diameter) of at least 2 μm are sampled at random. The image data are inputted into an image analyzer ("Luzex 3", available from Nireco K.K.) to obtain averages of shape factors SF-1 and SF-2 based on the following equations:

$$SF\text{-}1=[(\mathrm{MXLNG})^2/\mathrm{AREA}]\times(\pi/4)\times 100,$$

$$SF\text{-}2=[(\mathrm{PERI})^2/\mathrm{AREA}]\times(1/4\ \pi)\times 100,]$$

wherein MXLNG denotes the maximum length of a sample particle, PERI denotes the perimeter of a sample particle, and AREA denotes the projection area of the sample particle.

The shape factor SF-1 represents a roundness of toner particles, and a value thereof exceeding 160 means that the toner particles gradually loose a spherical shape to have an indefinite shape. The shape factor SF-2 represents a degree of surface unevenness of toner particles, and a value thereof exceeding 140 means a remarkable surface unevenness. The control of the shape factors to such small values is advantageous in the following respects. First, as a result of the control, the toner is caused to have a smaller contact area with the photosensitive member to show a lower attachment force, thus providing a higher transfer efficiency.

Figure 4:
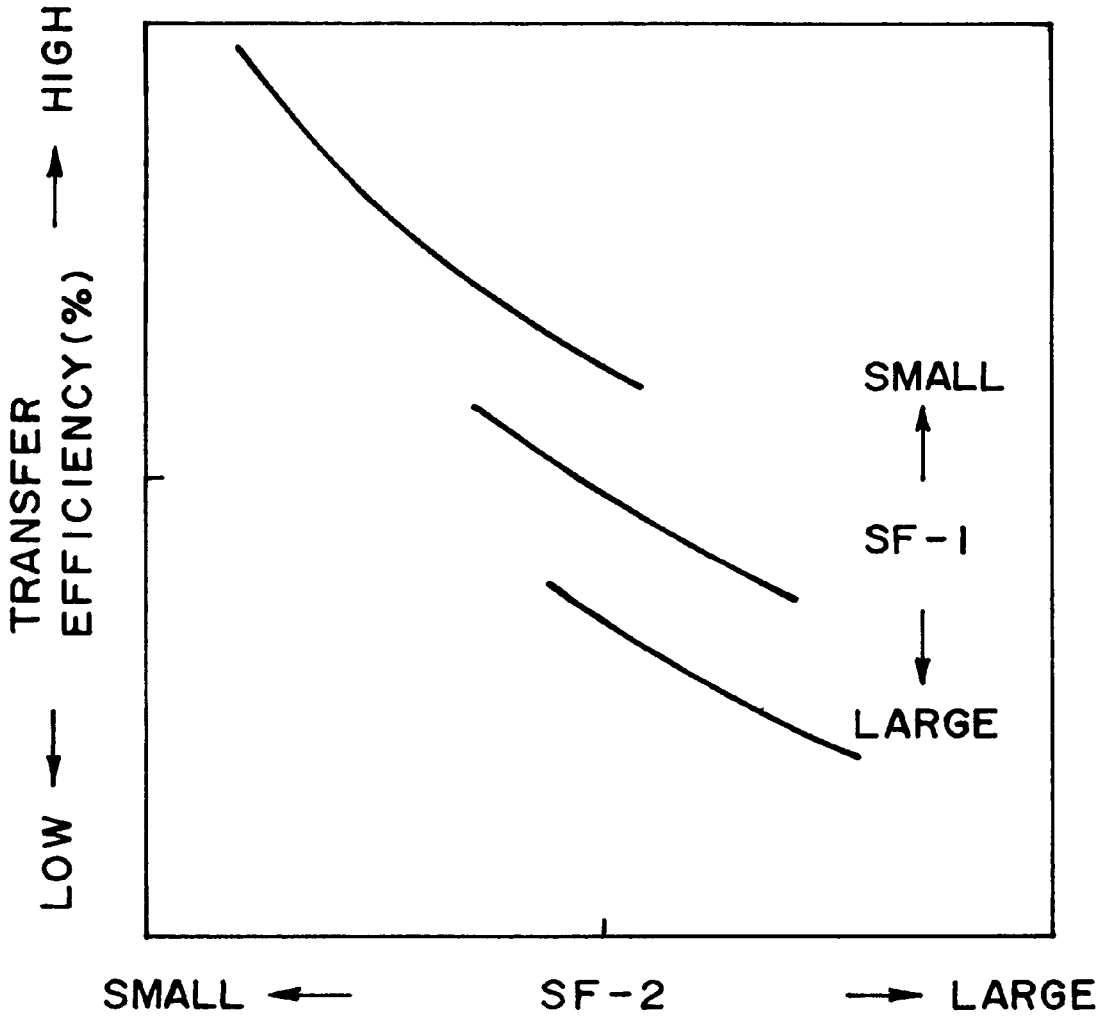
FIG. 4 is a graph showing a relationship between transfer efficiency and shape factors SF-1 and SF-2 of a toner.

FIG. 4 shows some relationships between the transfer efficiency and the shape factors. FIG. 4 shows that smaller shaper factors provide a higher transfer efficiency, which leads to a reduced amount of residual toner recovered into a cleaning device, so that the cleaning device can be reduced in size.

As a second effect, the use of spherical and surface-smooth toner particles provides a uniform charge to toner particles constituting a toner image transferred onto a transfer(-receiving) material or recording material, such as paper, so that it becomes possible to prevent a so-called re-transfer phenomenon that a portion of a toner image transferred onto a transfer material in a previous image forming cycle is electrostatically peeled or taken up onto the photosensitive drum. As a result, the toner image on the transfer material is not disturbed, thereby stably providing high-quality images.

However, if the toner shape is made closer to a spherical shape and surface-smooth, the resultant toner becomes disadvantageous in respect of chargeability because of fewer contact points between the toner surface and the charging member compared with an indefinitely shaped toner, thus being liable to cause toner scattering and fog in a high humidity environment, for example. Further, if the toner particles are round in shape, the external additive is liable to be embedded at the toner particle surface because of less cavities capable of functioning as a refuge from compression, thereby being liable to gradually lower the flowability and transferability of the toner.

However, as the toner according to the present invention contains the specific waxes in specific proportions, the toner particles can exhibit good flowability while retaining a good chargeability even if the toner has a shape close to a sphere and is surface-smooth, thus achieving a high transfer efficiency.

Further, in order to provide a higher image quality by faithfully reproducing minute latent image dots, the toner according to the present invention may preferably have a small weight-average particle size (D4) of 3–8 μm and a sharp particle size distribution as represented by a number-basis particle size variation coefficient of at most 35%. More specifically, a toner having a weight-average particle size of smaller than 3 μm exhibits a low transfer efficiency and is liable to leave an increased amount of residual toner on the photosensitive member and the intermediate transfer member, thus causing fog and image irregularity due to insufficient transfer. A toner having a weight-average particle size exceeding 8 μm is liable to exhibit a lower resolution or dot-reproducibility and also cause melt-sticking onto various members. This tendency is promoted if the number-basis particle size variation coefficient exceeds 35%.

The colorant used in the toner for developing electrostatic images may include: yellow colorant, magenta colorant and cyan colorant as described below, and further black colorant which may be carbon black, magnetic material or a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 109, 110, 111, 128, 129, 147, 168 and 180.

Examples of the magenta colorant may include: condensed azo compounds, diketopyrrolpyrrole compounds, anthraquinone compounds, quinacridone compounds, basis dye lake compounds, naphthol compounds, benzimidazole compounds, thioindigo compounds an perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basis dye lake compounds. Specific preferred examples thereof may include: C.I. Pigment Blue 1, 7, 15, 15:1, 15:2, 15:3, 15:4, 60, 62, and 66.

Carbon black preferably used as a black colorant in the present invention may preferably have a primary particle size of 25–80 nm. Below 25 nm, the primary particle size is too small, so that it becomes difficult to effect a sufficient dispersion and the handling becomes difficult. Above 80 nm, the resultant toner can exhibit a lower coloring power, so that only low-density images can be attained or the toner consumption is disadvantageously increased.

The primary particle size of the carbon black is more preferably 35–70 nm so as to ensure a uniform control of the polarity and amount of charge imparted to transfer residual toner by a charging member, and also provide a stable toner chargeability and a toner coloring power.

The primary particle size values of carbon black referred to herein are based on value measured on photographs taken through a transmission electron microscope.

Carbon black used in the present invention may preferably have a DBP (dibutyl phthalate)-absorptivity of 40–150 ml/100 g. Carbon black having a short structure as represented by a DBP-absorptivity of 40 ml/100 g provides a toner with only a low chargeability. Above 150 ml/100 g, fine dispersion of the carbon black becomes difficult because of rigid and long structure. DBP-absorptivities described herein are based on values measured according to ASTM D-2424-79.

Carbon black used in the present invention may preferably have a BET specific surface area according to nitrogen adsorption ($S_{BET}$) of at most 100 $m^2/g$ and a volatile content of at most 2 wt. %. The specific surface area and volatile content are at levels lower than those of carbon black frequently used heretofore in toners.

Carbon black having a small specific surface area and a small volatile content is advantages because it contains less polymerization-inhibiting functional group and it can be uniformly dispersed in the toner.

If the specific surface area exceeds 100 $m^2/g$, the carbon black is liable to inhibit the polymerization. Further, carbon black having a volatile content exceeding 2% is liable to have much polymerization inhibiting group at the surface and is thus unsuitable.

These colorants may be used singly or in combination of two or more species in mixture or in a state of solid solution. The above colorants may be appropriately selected in view of hue, color saturation, lightness, weather resistance, transparency of OHP film, and a dispersibility in toner particles. The above colorants may preferably be used in a proportion of 1–20 wt. parts per 100 wt. parts of the binder resin.

By using a magnetic material as a black colorant, the toner according to the present invention can be provided as a magnetic toner. Examples of such a magnetic material may include: iron oxides, magnetite, hematite and ferrite; metals, such as iron, cobalt and nickel, and alloys of these metals with aluminum, cobalt, copper, lead, magnesium, tin, zinc, antimony, beryllium, bismuth, cadmium, calcium, manganese, selenium, titanium, tungsten, or vanadium, and mixtures of the above.

The magnetic material used in the present invention may preferably be a surface-modified magnetic material. In the case of toner production by polymerization, it is preferred that the magnetic material has been hydrophobized with a surface-modifying agent free from polymerization inhibition. Examples of such surface-modifying agents may include: silane coupling agents and titanium coupling agents.

Such a magnetic material may preferably have an average particle size of at most 2 μm, more preferably ca. 0.1–0.5 μm. The magnetic material may preferably be contained in the toner in 20–200 wt. parts, more preferably 40–150 wt. parts, per 100 wt. parts of the binder resin. It is further preferred that the magnetic material has magnetic properties including a coercive force (Hc) of 20–300 oersted, a saturation magnetization ($\sigma_s$) of 50–200 emu/g and a residual magnetization ($\sigma_r$) of 2–20 emu/g, as measured by application of a magnetic field of 10 kilo-oersted.

As a process for producing the toner for developing electrostatic images according to the present invention, it is particularly preferred to adopt a suspension polymerization process under a normal pressure or an elevated pressure capable of easily providing controlled toner particle shape factors SF-1 of 100–160 and SF-2 of 100–140 and small toner particles having an average particle size of 4–8 μm and a sharp particle size distribution. In this case, it is possible to control the average particle size and particle size distribution of the resultant toner particles by changing the species and amount of a hardly water-soluble inorganic salt or a dispersing agent functioning as a protective colloid; by controlling the mechanical process conditions, including stirring conditions such as a rotor peripheral speed, a number of passes and a stirring blade shape, and a vessel shape; and/or by controlling a weight percentage of solid matter in the aqueous dispersion medium. As a result, the toner according to the present invention having desired characteristics can be obtained.

In the case of directly producing the toner particles through the suspension polymerization process, the monomer may preferably be a vinyl-type monomer, examples of which may include: styrene and its derivatives such as styrene, o-, m- or p-methylstyrene, and m- or p-ethylstyrene; (meth)acrylic acid esters such as methyl (meth)acrylate, ethyl (meth)acrylate, propyl (meth)acrylate, butyl (meth) acrylate, octyl (meth)acrylate, dodecyl (meth)acrylate, 2-ethylhexyl (meth)acrylate, stearyl (meth)acrylate, behenyl (meth)acrylate, dimethylaminoethyl (meth)acrylate, and diethylaminoethyl (meth)acrylate; butadiene; isoprene; cyclohexene; (meth)acrylonitrile, and acrylamide.

The above monomers may be used singly or in appropriate mixture so as to provide a theoretical glass transition point (Tg), described in "POLYMER HANDBOOK", second addition, III-pp. 139–192 (available from John Wiley & Sons Co.), of 40–75° C. If the theoretical glass transition point is below 40° C., the resultant toner particles are lowered in storage stability and durability. On the other hand, the theoretical glass transition point is in excess of 75° C., the fixation temperature of the toner particles is increased, whereby respective color toner particles have an insufficient color-mixing characteristic, particularly in the case of the full-color image formation. As a result, the resultant toner particles have a poor color reproducibility and undesirably lower a transparency of an OHP film image.

In the present invention, the molecular-weight distribution of the binder resin may be measured by gel permeation chromatography (GPC) as follows. The toner particles are subjected to extraction with toluene for 20 hours by means of Soxhlet extractor in advance, followed by distilling-off of the solvent (toluene) from the extract liquid to recover a solid. An organic solvent (e.g., chloroform) is not dissolved is added to the solid and sufficiently washed therewith to obtain a residue product. The residue product is dissolved in tetrahydrofuran (THF) and subjected to filtration with a solvent-resistant membrane filter having a pore size of 0.3 $\mu$m to obtain a sample solution (THF solution) The sample solution is injected in a GPC apparatus ("GPC-150C", available from Waters Co.) using columns of A-801, 802, 803, 804, 805, 806 and 807 (manufactured by Showa Denko K.K.) in combination. The identification of sample molecular weight and its molecular weight distribution is performed based on a calibration curve obtained by using monodisperse polystyrene standard samples. In the present invention, the binder resin may preferably have a number-average molecular weight (Mn) of 5,000–1,000,000 and a ratio of weight-average molecular weight (Mw) to Mn (Mw/Mn) of 2–100.

In the present invention, it is particularly preferred that the above-mentioned ester wax (1) and the wax (2) are enclosed within the binder resin. For this purpose, it is particularly preferred to add a polar resin in the toner particles. Preferred examples of such a polar resin may include styrene-(meth) acrylate copolymer, maleic acid-based copolymer, saturated or unsaturated polyester resin and epoxy resin.

The charge control agent used as desired for stabilizing the triboelectric chargeability of the toner in the present invention may preferably be one which has a higher charging speed and a property capable of stably retaining a prescribed charge amount. In the case of using the direct polymerization for producing the toner particles of the present invention, the charge control agent may particularly preferably be one free from polymerization-inhibiting properties.

The charge control agent used in the present invention may be those of negative-type or positive-type. Specific examples of the negative charge control agent may include: metal-containing acid-based compounds comprising acids, such as salicylic acid, alkylsalicylic acid, dialkylsalicylic acid, naphtoic acid, dicarboxylic acid and derivatives of these acids; polymeric compounds having a side chain comprising sulfonic acid or carboxylic acid; boron compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent may preferably be used in a proportion of 0.5–10 wt. parts per 100 wt. parts of the binder resin. However, the charge control agent is not an essential component of the toner in the present invention. In the case of using two-component developing method, it is possible to utilize triboelectric charge with a carrier and it is possible to omit a charge control agent.

Examples of the polymerization initiator usable in the direct polymerization may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be selectively used singly or in mixture with reference to 10-hour half-life period temperature.

In order to control the molecular weight of the resultant binder resin, it is also possible to add a crosslinking agent, a chain transfer agent, a polymerization inhibitor, etc.

In the suspension polymerization, it is generally preferred to use 300–3000 wt. parts of water as the dispersion medium per 100 wt. parts of the monomer composition. In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner according to the present invention may preferably be blended with external additives inclusive of: lubricant powder, such as polytetrafluoroethylene powder, zinc stearate powder, and polyvinylidene fluoride powder; abrasives, such as cerium oxide, silicon carbide, and strontium titanate; flowability improvers, such as silica, titanium oxide, and aluminum oxide; anti-caking agents; and electroconductivity-imparting agents, such as carbon black, zinc oxide, and tin oxide. It is particularly preferred to add inorganic fine powder, such as fine powder of silica, titanium oxide or aluminum oxide. It is preferred that the inorganic fine has been hydrophobized with a hydrophobicity-imparting agent, such as a silane coupling agent, silicone oil or a combination thereof.

Such an external additive may ordinarily be added in an amount of 0.1–5 wt. parts per 100 wt. parts of the toner particles.

The toner according to the present invention may preferably be used to provide a two-component developer. In this case, the toner is used together with a carrier.

The carrier need not be restricted particularly but may principally comprise a magnetic ferrite of elements such as iron, copper, zinc, nickel, cobalt, manganese and chromium, or a magnetic composite of such ferrites. The carrier particles may be shaped spherical, flat or irregular in view of the saturation magnetization and electrical resistivity. The surface microscopic structure, such as surface unevenness, of the carrier may also be controlled desirably. Generally, the above-mentioned inorganic oxide or ferrite may be calcined, and formed into core particles, which may be then coated with a resin. However, it is possible to produce a low-density dispersion type carrier by kneading the inorganic oxide and a resin, followed by pulverization and classification, so as to reduce the load of the carrier onto the toner; or to produce a true-spherical dispersion carrier by subjecting a mixture of the inorganic oxide and a monomer to suspension polymerization in an aqueous medium.

It is particularly preferred to provide a carrier coated with a resin. The coating may for example be performed by dissolving or dispersing a coating resin in a solvent, followed by attachment onto carrier, or by powder mixing of the coating resin with the carrier.

Examples of the coating material firmly applied onto the carrier core particles may include: polytetrafluoroethylene, monochlorotrifluoroethylene polymer, polyvinylidene fluoride, silicone resin, polyester resin, styrene resin, acrylic resin, polyamide, polyvinyl butyral, nigrosine, and aminoacrylate resin. These coating materials may be used singly or in combination of plural species.

The coating material may be applied onto the core particles in a proportion of 0.1–30 wt. %, preferably 0.5–20 wt. %, based on the carrier core particles. The carrier may preferably have an average particle size of 10–100 $\mu$m, more preferably 20–50 $\mu$m.

A particularly preferred type of carrier may comprise particles of a magnetic ferrite such as Cu—Zn—Fe ternary ferrite surface-coated with a fluorine-containing resin or a styrene-based resin. Preferred coating materials may include mixtures of a fluorine containing resin and a styrene copolymer, such as a mixture of polyvinylidene fluoride and styrene-methyl methacrylate resin, and a mixture of polytetrafluoroethylene and styrene-methyl methacrylate resin. The fluorine-containing resin may also be a copolymer, such as vinylidene fluoride/tetrafluoroethylene (10/90–90/10) copolymer. Other examples of the styrene-based resin may include styrene/2-ethylhexyl acrylate (20/80–80/20) copolymer and styrene/2-ethylhexyl acrylate/methyl methacrylate (20–60/5–30/10–50) copolymer. The fluorine-containing resin and the styrene-based resin may be blended in a weight ratio of 90:10–20:80, preferably 70:30–30:70.

The above-mentioned coated magnetic ferrite carrier shows a preferable triboelectric charging performance for the toner according to the invention and provides a two-component type developer with improved electrophotographic performances.

The toner according to the invention and a carrier may be blended in such a ratio as to provide a toner concentration of 2–15 wt. %, preferably 4–13 wt. %, whereby good results are obtained ordinarily.

The carrier may preferably have a magnetization at 1000 Oersted after magnetic saturation ($\sigma_{1000}$) of 30–300 emu/cm$^3$, further preferably 100–250 emu/cm$^3$, for high quality image formation. In excess of 300 emu/cm$^3$, there is a tendency that it is difficult to obtain high-quality toner images. Below 30 emu/cm$^3$, carrier attachment is liable to occur because of decreased magnetic constraint.

Now, the image forming method using the above-mentioned toner according to the present invention will be described.

Figure 5:
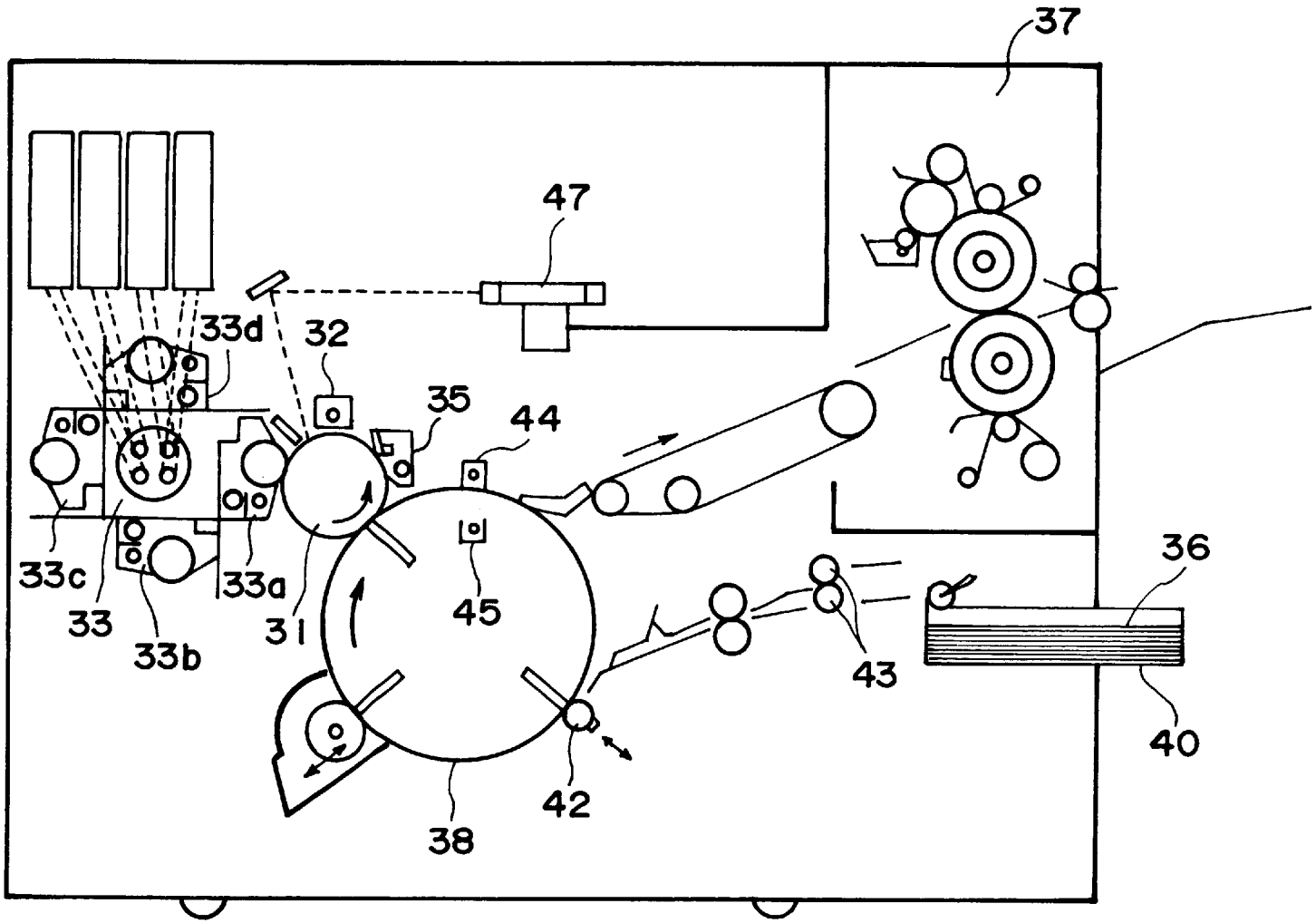
FIG. 5 illustrates an image forming apparatus used in an embodiment of the image forming method according to the invention.

FIG. 5 is a sectional view of a full-color image forming apparatus wherein a two-component developer obtained by blending the toner according to the present invention with a carrier is suitably used.

The image forming apparatus shown in FIG. 5 is roughly divided into a transfer material conveying section including a transfer drum 38 and extending from the right side (the right side of FIG. 5) to almost the central part of an apparatus main assembly, a latent image-forming section disposed close to the transfer drum 38, and a developing means (i.e., a rotary developing apparatus 33).

The transfer material-conveying section includes an opening formed in a right wall of the apparatus main assembly, and a transfer material supply tray 40 containing transfer material 36 and disposed in the opening so as to protrude a part thereof out of the assembly. The tray 40 is provided with a paper supply roller, in association with which conveyer rollers 43 and a paper supply guide are disposed so as to supply a transfer material (e.g., paper) to a rotatable transfer drum 38 disposed leftward thereof. Adjacent to the outer periphery of the transfer drum 38, an abutting roller 42, a transfer material separation charger 44 and a separation claw are disposed in this order from the upstream to the downstream along the rotation direction.

Inside the transfer drum 38, a transfer charger and a transfer material separation charger 45 are disposed. A portion of the transfer drum 38 about which a transfer material is wound is provided with a transfer sheet (not shown) attached thereto, formed of a polymer, such as polyvinylidene fluoride, and a transfer material is closely applied thereto electrostatically. On the right side above the transfer drum 38, a conveyer belt means is disposed close to the separation claw, and at the end (right side) in transfer direction of the conveyer belt means, a fixing device 37 including a heating roller and a pressure roller is disposed.

In the latent image forming section, a photosensitive member (e.g., an OHP photosensitive drum 31 as a latent image-bearing member rotatable in an arrow direction is disposed with its peripheral surface in contact with the peripheral surface of the transfer drum 38. Generally above and in proximity with the peripheral surface of the photosensitive drum 31, there are sequentially disposed a discharging charger, a cleaning means 35 and a primary charger 32 from the upstream to the downstream in the rotation direction of the photosensitive drum 31. Further, an imagewise exposure system including an imagewise exposure means 47 such as a laser beam scanner and an image light reflection means such as a mirror, is disposed so as to form an electrostatic latent image on the outer peripheral surface of the photosensitive drum 31.

The rotary developing apparatus 33 is provided with a rotatable housing disposed at a position opposing the photosensitive drum 31 and including four types of developing devices (i.e., a yellow developing device 33*a*, a magenta developing device 33*b*, a cyan developing device 33*c* and a black developing device 33*d*) disposed at equally distant four radial directions so as to develop an electrostatic latent image formed on the outer peripheral surface of the photosensitive drum.

In an image forming operation, as the photosensitive drum 31 is rotated in the arrow direction, the drum 31 is charged by the primary charger 32. In the apparatus shown in FIG. 5, the moving peripheral speeds (hereinafter called "process speed") of the respective members, particularly the photosensitive drum 31, may be at least 100 mm/sec, (e.g., 130–250 mm/sec). After the charging of the photosensitive drum 31 by the primary charger 32, the photosensitive drum 31 is exposed imagewise with laser light modulated with a yellow image signal from an original image to form a corresponding latent image on the photosensitive drum 31, which is then developed by the yellow developing device 33*a* set in position by the rotation of the rotary developing apparatus 33, to form a yellow toner image.

A transfer material (e.g., plain paper) sent via the paper supply roller 43 and the paper supply guide is taken at a prescribed timing and is wound about the transfer drum 38 by means of the abutting roller 42 and an electrode disposed opposite the abutting roller 42. The transfer drum 38 is rotated in the arrow direction in synchronism with the photosensitive drum 31 whereby the yellow toner image formed by the yellow-developing device is transferred onto the transfer material at a position where the peripheral surfaces of the photosensitive drum 31 and the transfer drum 38 abut each other under the action of the transfer charger. The transfer drum 38 is further rotated to be prepared for transfer of a next color (magenta in the case of FIG. 5).

On the other hand, the photosensitive drum 31 is charge-removed by the discharging charger, cleaned by a cleaning blade or cleaning means 35, again charged by the primary charger 32 and then exposed imagewise based on a subsequent magenta image signal, to form a corresponding electrostatic latent image. While the electrostatic latent image is formed on the photosensitive drum 31 by imagewise exposure based on the magenta signal, the rotary developing apparatus 33 is rotated to set the magenta developing device 32*b* in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 44 and 45, released and separated from the transfer drum 38 by the separation claw and sent via the conveyer belt to the fixing device 37, where the four-color toner images are fixed under heat and pressure to provide a full-color print image.

Figure 6:
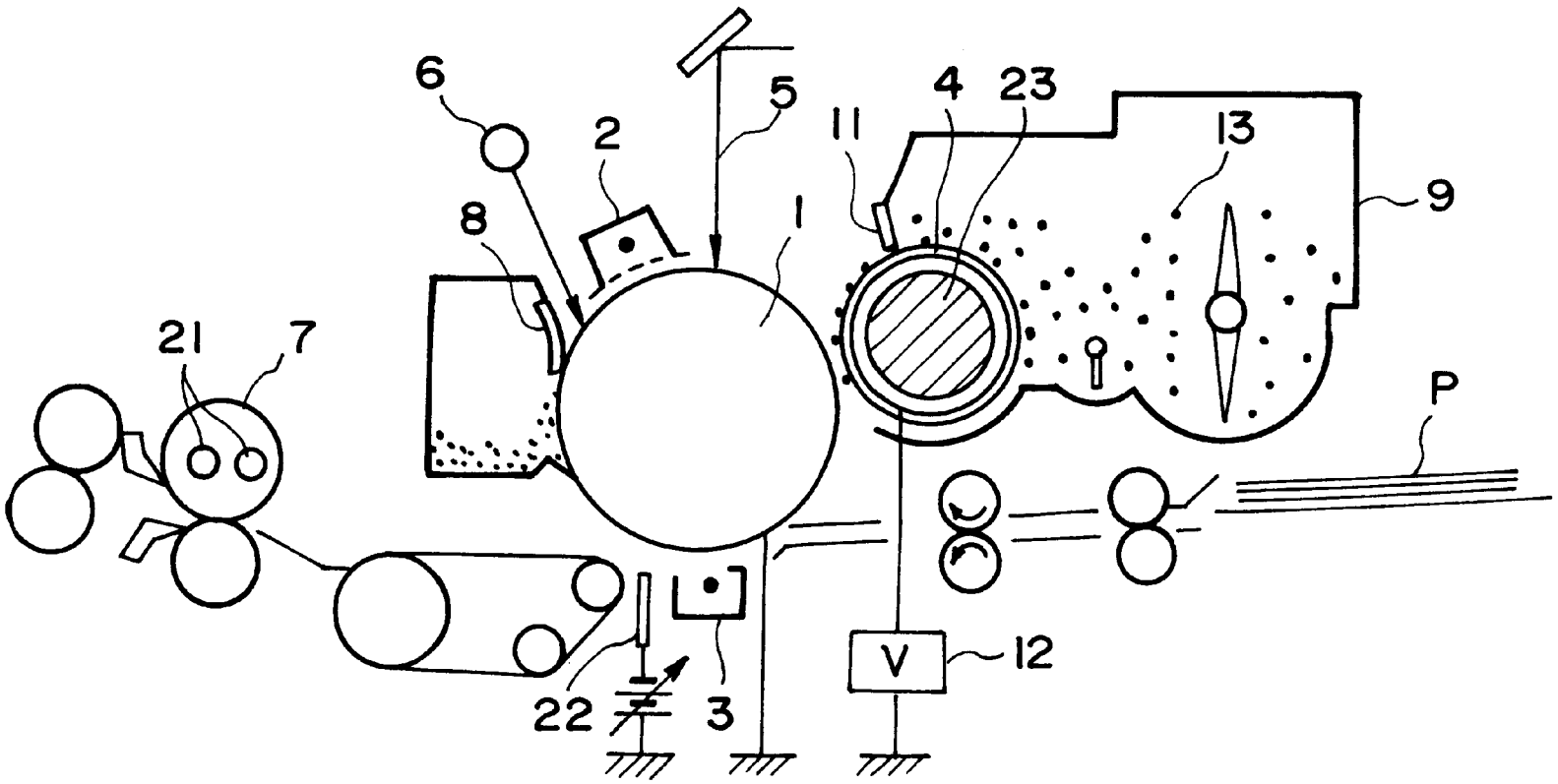
FIG. 6 illustrates another image forming apparatus applicable to the invention.

Now, an embodiment of the image forming method using a toner, particularly a magnetic toner, according to the present invention will be described with reference to FIGS. 6 and 7. The surface of an electrostatic image-bearing member (photosensitive member) 1 is charged to a negative potential or a positive potential by a primary charger 2 and exposed to image light 5 as by analog exposure or laser beam scanning to form an electrostatic image (e.g., a digital latent image as by laser beam scanning) on the photosensitive member. Then, the electrostatic image is developed with a magnetic toner 13 carried on a developing sleeve (developer-carrying member) 4 according to a reversal development mode or a normal development mode. The toner 13 is initially supplied to a vessel of a developing device 9 and applied as a layer by a magnetic blade 11 on the developing sleeve 4 containing therein a magnet 23 having magnetic poles $N_1$, $N_2$, $S_1$ and $S_2$. At the development zone, a bias electric field is formed between the electroconductive substrate of the photosensitive member 1 and the developing sleeve 4 by applying an alternating bias, a pulse bias and/or a DC bias voltage from a bias voltage application means 12 to the developing sleeve 4.

The magnetic toner image thus formed on the photosensitive member 1 is transferred via or without via an intermediate transfer member onto a transfer-receiving material (transfer paper) P. When transfer paper P is conveyed to a transfer position, the back side (i.e., a side opposite to the photosensitive member) of the paper P is positively or negatively charged to electrostatically transfer the negatively or positively charged magnetic toner image on the photosensitive member 1 onto the transfer paper P. Then, the transfer paper P carrying the toner image is charge-removed by discharge means 22, separated from the photosensitive member 1 and subjected to heat-pressure fixation of the toner image by a hot pressure roller fixing device 7 including a heating roller equipped with internal heaters 21.

Residual magnetic toner remaining on the photosensitive member 1 after the transfer step is removed by a cleaning means comprising a cleaning blade 8. The photosensitive member 1 after the cleaning is charge-removed by erase exposure means 6 and then again subjected to an image forming cycle starting from the charging step by the primary charger 2.

Figure 7:
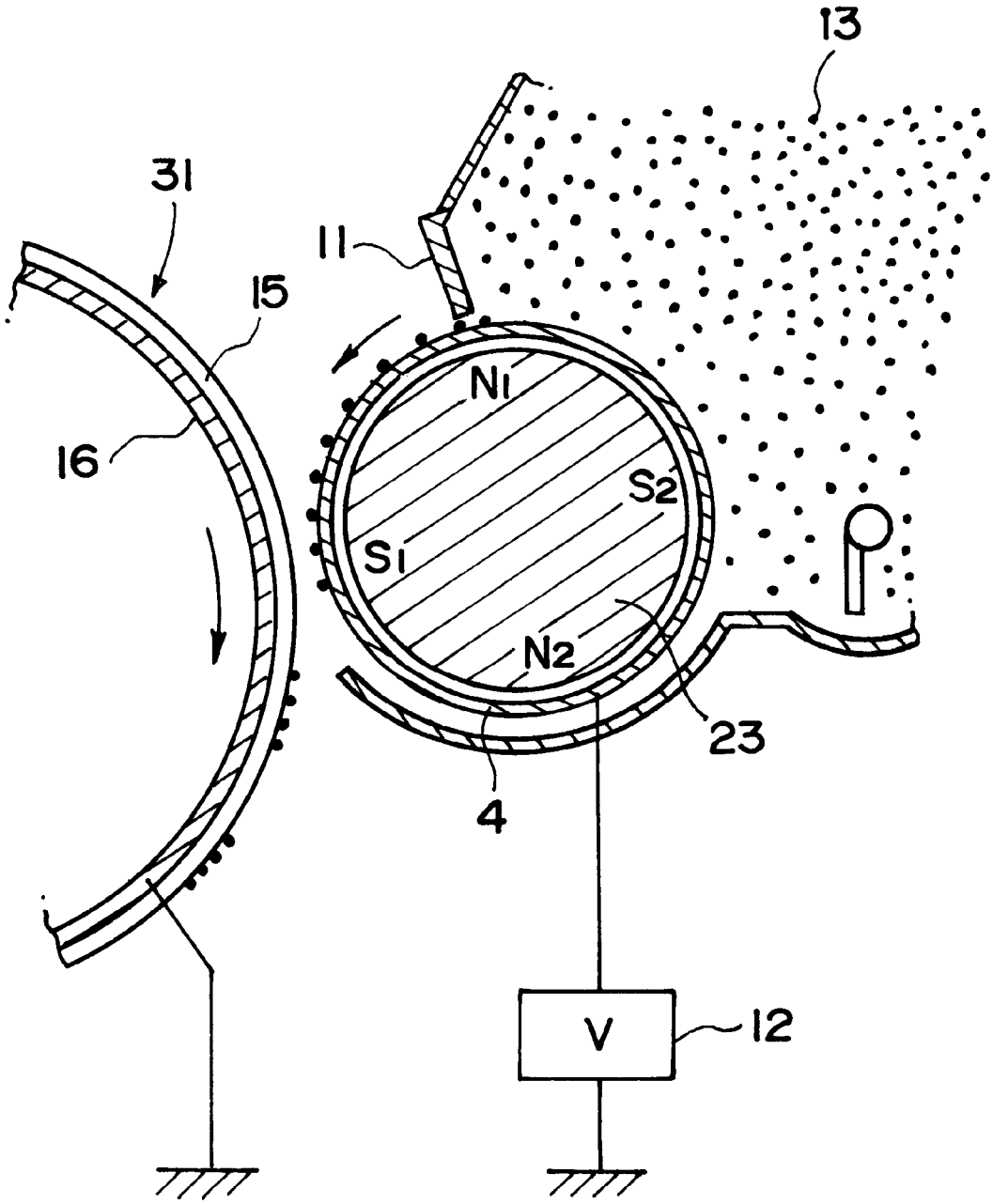
FIG. 7 is an enlarged illustration of a developing section of the image forming apparatus shown in FIG. 6.

The electrostatic image bearing or photosensitive member in the form of a drum 1 may comprise a photosensitive layer 15 formed on an electroconductive support 16 (FIG. 7). The non-magnetic cylindrical developing sleeve 4 is rotated so as to move in an identical direction as the photosensitive member 1 surface at the developing position. Inside the non-magnetic cylindrical developing sleeve 4, a multi-polar permanent magnet (magnet roll) 23 is disposed so as to be not rotated. The magnetic toner 13 in the developing device 9 is applied onto the developing sleeve 4 and provided with a triboelectric change due to friction between the developing sleeve 4 surface and the magnetic toner particles. Further, by disposing an iron-made magnetic blade 11 in proximity to (e.g., with a gap of 50–500 $\mu$m from) the developing sleeve 4 surface so as to be opposite to one magnetic pole of the multi-polar permanent magnet, the magnetic toner is controlled to be in a uniformly small thickness (e.g., 30–300 $\mu$m) that is identical to or smaller than the clearance between the photosensitive member 1 and the developing sleeve 4 at the developing position. The rotation speed of the developing sleeve 4 is controlled so as to provide a circumferential velocity identical or close to that of the photosensitive member 1 surface. The iron blade 11 as a magnetic doctor blade can be replaced by a permanent magnet so as to provide a counter magnetic pole. At the developing position, an AC bias or a pulse bias voltage may be applied to the developing sleeve 4 from a bias voltage application means. The AC bias voltage may preferably have a frequency 5 of 200–4,000 Hz and a peak-to-peak voltage Vpp of 500–3,000 volts.

Under the action of an electrostatic force on the photosensitive member surface and the AC bias or pulse bias electric field at the developing position, the magnetic toner particles are transferred onto an electrostatic image on the photosensitive member 1.

It is also possible to replace the magnetic blade 11 with an elastic blade comprising an elastic material, such as silicone rubber, so as to apply a pressing force for applying a magnetic layer on the developing sleeve while regulating the magnetic toner layer thickness.

Another image forming method to which to toner according to the present invention is applicable will now be described with reference to FIGS. 8–10.

Figure 8:
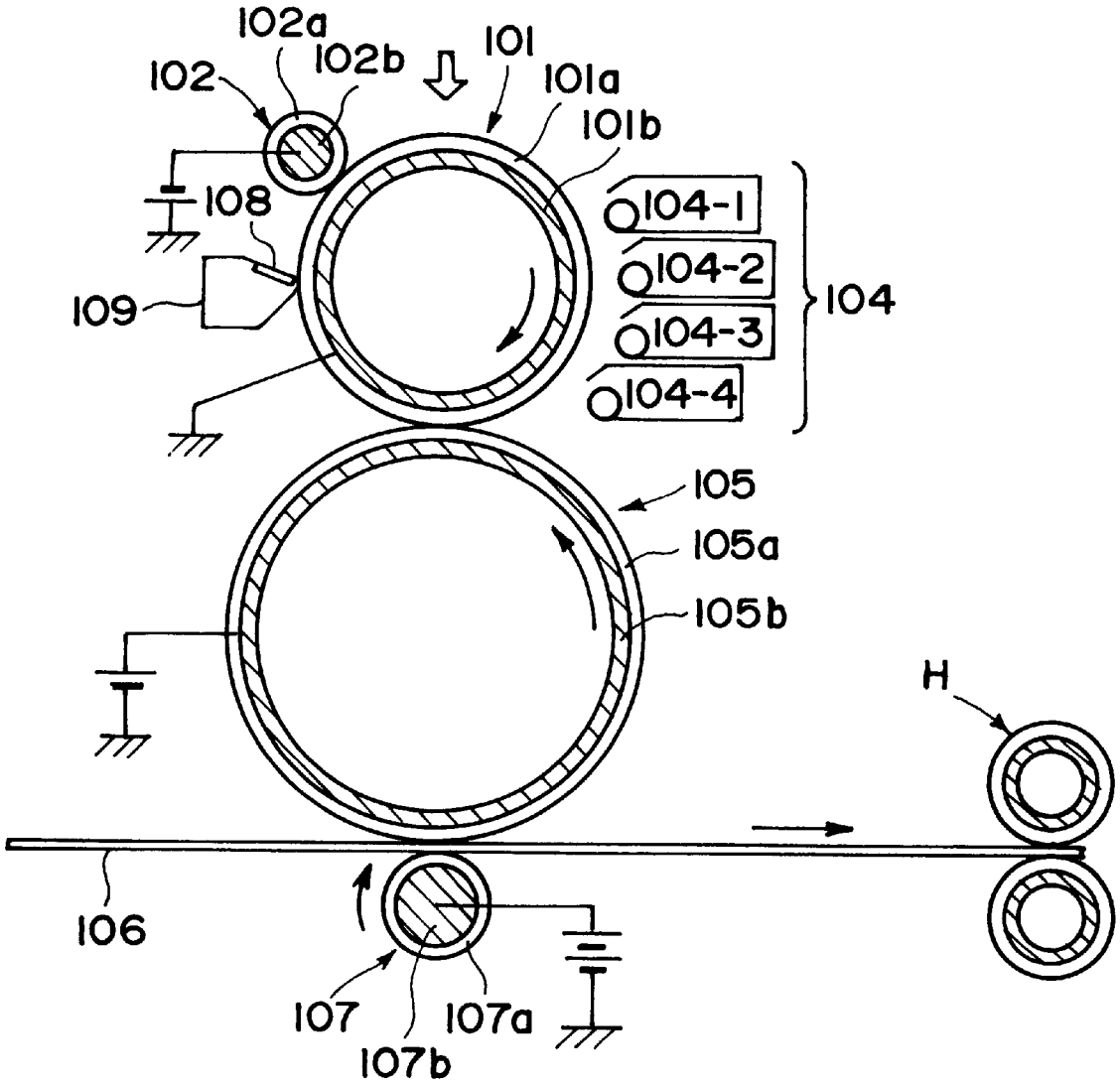
FIG. 8 illustrates another image forming apparatus usable in the invention.

Referring to FIG. 8, an image forming apparatus principally includes a photosensitive member 101 as an electrostatic image-bearing member, a charging roller 102 as a charging means, a developing device 104 comprising four developing units 104-1, 104-2, 104-3 and 104-4, an intermediate transfer member 105, a transfer roller 107 as a transfer means, and a fixing device H as a fixing means.

Four developers comprising cyan toner particles, magenta toner particles, yellow toner particles, and black toner particles are incorporated in the developing units 104-1 to 104-4. An electrostatic image is formed on the photosensitive member 101 and developed with the four color toner particles by a developing method such as a magnetic brush developing system or a non-magnetic monocomponent developing system, whereby the respective toner images are formed on the photosensitive member 101.

Figure 9:
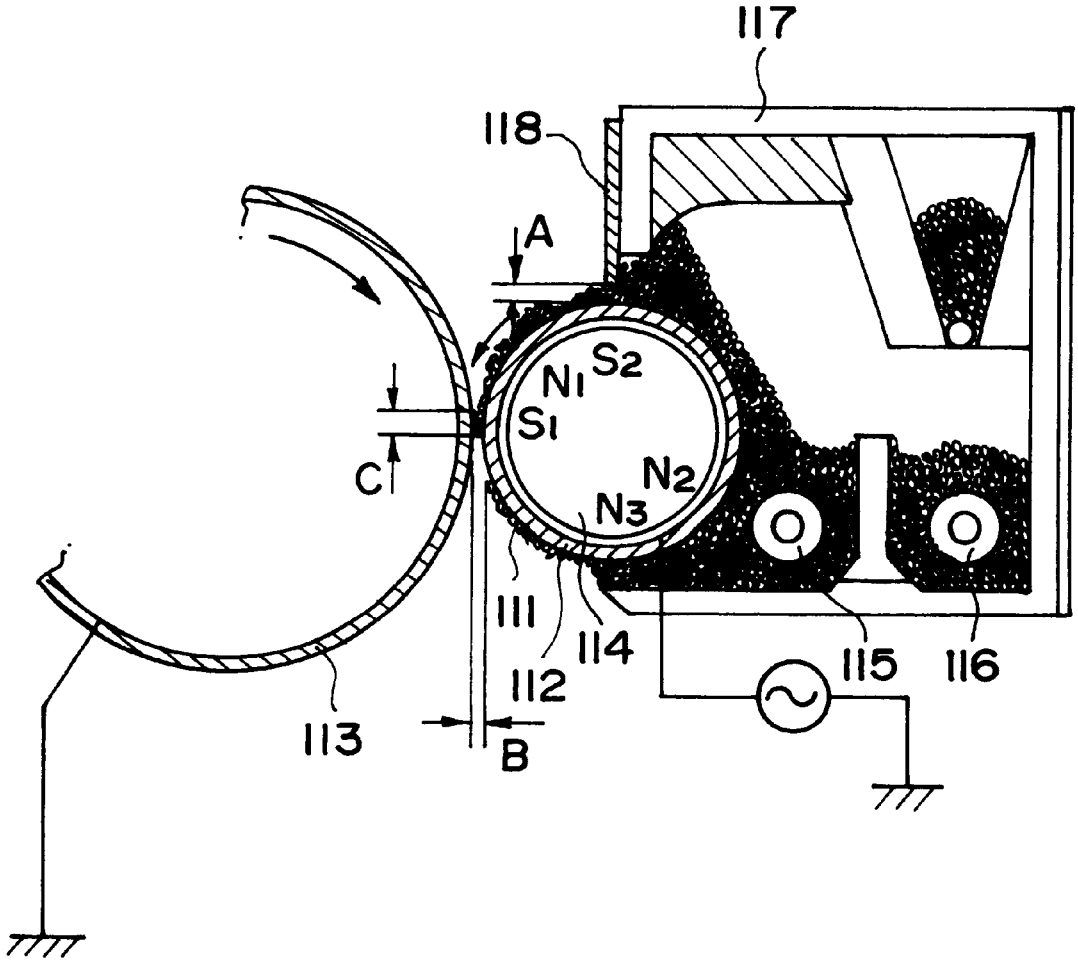
FIG. 9 illustrates an essential part of a two-component developing apparatus usable in the invention.

A non-magnetic toner according to the present invention may be blended with a magnetic carrier and may be used for development by using a developing means as shown in FIG. 9. It is preferred to effect a development in a state where a magnetic brush contacts a latent image-bearing member, e.g., a photosensitive drum 113 under application of an alternating electric field. A developer-carrying member (developing sleeve) 111 may preferably be disposed to provide a gap B of 100–1000 $\mu$m from the photosensitive drum 113 in order to prevent the toner attachment and improve the dot reproducibility. If the gap is narrower than 100 $\mu$m, the supply of the developer is liable to be insufficient to result in a low image density. In excess of 1000 $\mu$m, the lines of magnetic force exerted by a developing pole S1 is spread to provide a low density of magnetic brush, thus being liable to result in an inferior dot reproducibility and a weak carrier constraint force leading to carrier attachment.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 111 with the photosensitive drum 113 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 118 and the developing sleeve 111 and/or changing the gap B between the developing sleeve 111 and the photosensitive drum 113.

In formation of a full color image for which a halftone reproducibility is a great concern may be performed by using at least 3 developing devices for magenta, cyan and yellow, adopting the toner according to the present invention and preferably adopting a developing system for developing digital latent images in combination, whereby a development faithful to a dot latent image becomes possible while avoiding an adverse effect of the magnetic brush and disturbance of the latent image.

The toner according to the present invention may also be realized as a non-magnetic or magnetic toner for a monocomponent development method. FIGS. 10 and 11 respectively illustrate an example such a development apparatus.

Figure 10:
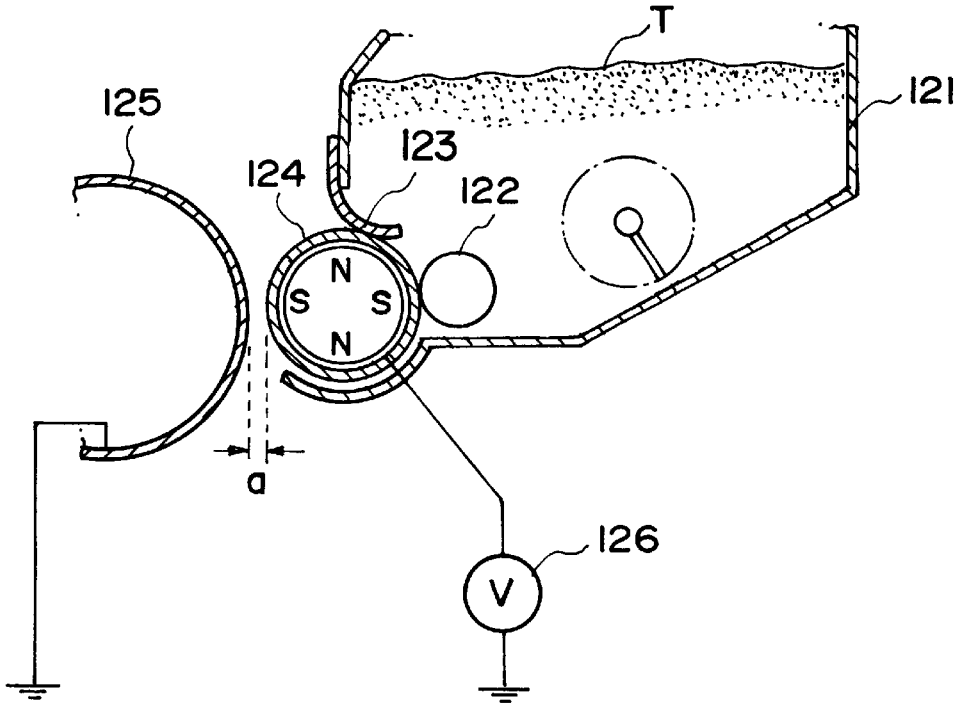
FIG. 10 illustrates another image forming apparatus usable in the invention.
Figure 11:
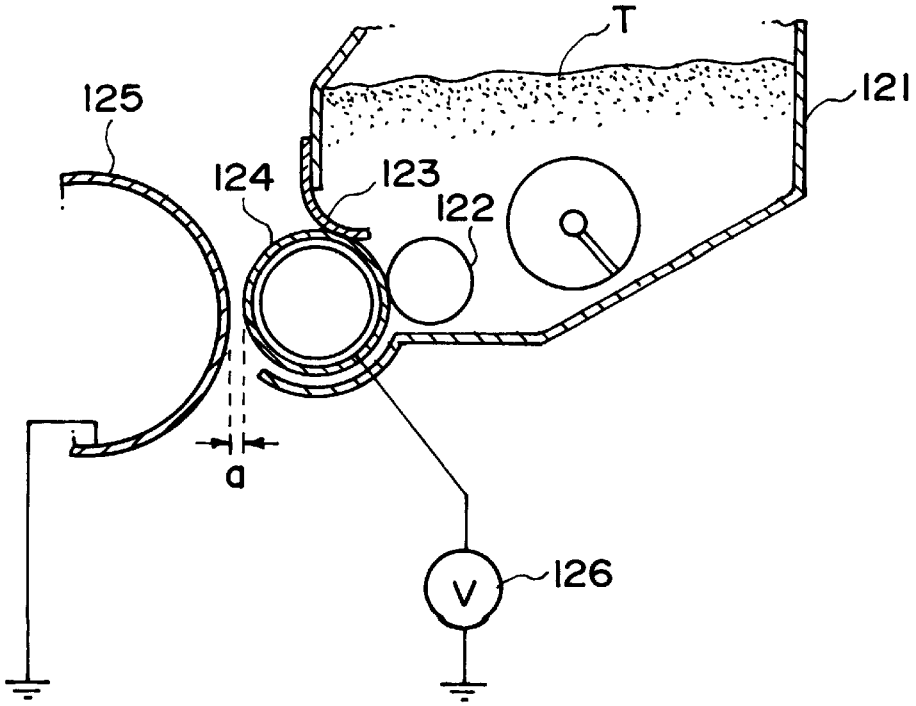
FIG. 11 illustrates an enlarged sectional view of an essential part of developing apparatus using a mono-component developer.

Referring to FIGS. 10 and 11, an electrostatic image formed on an electrostatic image-bearing member 125 by electrophotography or electrostatic recording may be developed with a toner T contained in a toner vessel 121 and applied on a non-magnetic developing sleeve (developer-carrying member) 124 comprising aluminum or stainless steel.

Almost a right half circumference of the developing sleeve is caused to always contact the toner T stored in the toner vessel 121, and the toner in proximity to the developing sleeve 124 is attached to and carried on the developing sleeve 124 under the action of a magnetic force generated by a magnetic field-generating means in the developing sleeve and/or an electrostatic force.

The toner carrying member 124 may have a surface roughness Ra set to 1.5 $\mu$m or smaller, preferably 1.0 $\mu$m or smaller, further preferably 0.5 $\mu$m or smaller.

By setting the surface roughness Ra to at most 1.5 $\mu$m, the toner particle-conveying force of the toner carrying member is suppressed to allow the formation of a thin toner layer on the developer-carrying member and increase the number of contents between the developer-carrying member and the toner, to thereby improve the toner chargeability.

In case where the surface roughness Ra of the toner carrying member exceeds 1.5, it become difficult to form a thin layer of toner on the developer-carrying member and improve the toner chargeability, so that the improvement in image quality becomes difficult to realize.

The surface roughness Ra of the developer-carrying member refers to a center line-average roughness as measured by a surface roughness tester ("Surfcoder SE-30H", available from K.K. Kosaka Kenkyusho) according to JIS B0601. More specifically, the surface roughness Ra may be determined by taking a measurement length a of 2.5 mm along a center line (taken on an x-axis) and taking a roughness on a y-axis direction to represent the roughness curve by a function of y=f(x) to calculate a surface roughness Ra ($\mu$m) from the following equation:

$$Ra = (1/a)\int_0^a |f(x)|dx.$$

The developer carrying member may preferably comprise a cylinder or a belt of stainless steel, aluminum, etc., which may be surface-coated with a metal, a resin, or a resin containing fine particles of a resin, a metal, carbon black or a charge control agent.

If the surface-moving velocity of the developer-carrying member is set to be 1.05–3.0 times the surface moving speed of the electrostatic image-bearing member, the toner layer on the developer-carrying member receives an appropriate degree of stirring effect to realize a better faithful reproduction of an electrostatic image.

If the surface speed of the developer-carrying member is below 1.05 times that of the electrostatic image-bearing member, such a toner layer stirring effect is insufficient, so that it becomes difficult to expect a good image formation. Further, in the case of forming a solid image requiring a large amount of toner over a wide area, the toner supply to the electrostatic image is liable to be insufficient to result in a lower image density. On the other hand, in excess of 3.0, the toner is liable to be excessively charged and cause difficulties, such as toner deterioration or sticking onto the developer-carrying member (developing sleeve).

The toner T stored in the hopper (toner vessel) 121 is supplied to the developing sleeve 124 by means of a supply member 122. The supply member may preferably be in the form of a supply roller comprising a porous elastic material or a foam material, such as soft polyurethane foam. The supply roller 122 is rotated at a non-zero relative velocity in a forward or reverse direction with respect to the developing sleeve, whereby the peeling of the toner (a portion of the toner not used for development) from the developing sleeve simultaneously with the toner supply to the developing sleeve. In view of the balance between the toner supply and toner peeling, the supply roller 122 may preferably be abutted to the developing sleeve in a width of 2.0–10.0 mm, more preferably 4.0–6.0 mm. On the other hand, a large stress is liable to be applied to the toner to promote the toner deterioration or agglomeration or melt-sticking of the toner onto the developing sleeve and the supply roller, but, as the toner according to the present invention is excellent in flowability, releasability and durability, so that the toner is suitably used in the developing method using such a supply roller. The supply member can also comprise a brush member of resinous fiber of, e.g., nylon or rayon. The use of such a supply member is very effective for a non-magnetic monocomponent toner not capable of utilizing a magnetic constraint forth for toner application but can also be applicable to a monocomponent development method using a magnetic monocomponent method.

The toner supplied to the developing sleeve can be applied uniformly in a thin layer by a regulation member. The thin toner layer-regulating member may comprise a doctor blade, such as a metal blade or a magnetic blade, disposed with a certain gap from the developing sleeve, or alternatively may comprise a rigid roller or a sleeve of a metal, a resin or a ceramic material, optionally including therein a magnetic field generating means.

Alternatively, it is also possible to constitute such a thin toner layer-regulating member as an elastic member, such as an elastic blade or an elastic roller, for applying a toner under pressure. FIG. 10, for example, shows an elastic blade 123 fixed at its upper but root portion to the developer vessel 121 and having its lower free length portion pressed at an appropriate pressure against the developing sleeve so as to extend in a reverse direction (as shown or in a forward direction). By using such an application means, it becomes possible to form a tight toner layer stable against an environmental change.

The elastic material may preferably comprise a material having an appropriate chargeability position in a triboelectric chargeability series so as to charge the toner to an appropriate polarity and may for example comprise: an elastomer, such as silicone rubber, urethane rubber or NBR; an elastic synthetic resin, such as polyethylene terephthalate; an elastic metal, such as stainless steel, steel and phosphor bronze; or a composite material of these.

In the case of providing a durable elastic member, it is preferred to use a laminate of an elastic metal and a resin or rubber or use a coated member.

Further, the elastic material can contain an organic material or an inorganic material added thereto, e.g., by melt-mixing or dispersion. For example, by adding a metal oxide, a metal powder, a ceramic, carbon allotrope, whisker, inorganic fiber, dye, pigment or a surfactant, the toner chargeability can be controlled. Particularly, in the case of using an elastic member formed of a rubber or a resin, it is preferred to add fine powder of a metal oxide, such as silica, alumina, titania, tin oxide, zirconia oxide or zinc oxide; carbon black; or a charge control agent generally used in toners.

Further, by applying a DC and/or AC electric field to the blade regulation member, or the supply roller or brush member, it becomes possible to exert a disintegration action onto the toner layer, particularly enhance the uniform thin layer application performance and uniform chargeability at the regulating position, and the toner supply/peeling position at the supply position, thereby providing increased image density and better image quality.

The elastic member may be abutted against the developer-carrying member at an abutting pressure of at least 0.1 kg/m, preferably 0.3–25 kg/m, further preferably 0.5–12 kg/m, in terms of a linear pressure in the direction of a generatrix of the developer-carrying member. As a result, it becomes possible to effectively disintegrate the toner to realize a quick charging of the toner. If the abutting pressure is below 0.1 kg/m, the uniform toner application becomes difficult to result in a broad toner charge distribution leading to fog and scattering. Above 25 kg/m, an excessive pressure is applied to the toner to cause toner deterioration or toner agglomeration, and a large torque becomes necessary for driving the developer-carrying member.

It is preferred to dispose the electrostatic image-bearing member 125 and the developer-carrying member 124 with a gap $\alpha$ of 50–500 $\mu$m, and a doctor blade may disposed with a gap of 50–400 $\mu$m from the toner-carrying member.

It is generally most preferred that the toner layer thickness is set to be thinner than the gap between the electrostatic image-bearing member and the developer-carrying member, but the toner layer thickness can be set so that a portion of toner ears constituting the toner layer contacts the electrostatic image-bearing member.

Further, by forming an alternating electric field between the electrostatic image-bearing member and the developer-carrying member from a bias voltage supply 126, it becomes possible to facilitate the toner movement from the developer-carrying member to the electrostatic image-bearing member, thereby providing a better quality of images. The alternating electric field may comprise a peak-to-peak voltage Vpp of at least 100 volts, preferably 200–3000 volts, further preferably 300–2000 volts, and a frequency f of 500–5000 Hz, preferably 1000–3000 Hz, further preferably 1500–3000 Hz. The alternating electric field may comprise a waveform of a rectangular wave, a sinusoidal wave, a sawteeth wave or a triangular wave. Further, it is also possible to apply an asymmetrical AC bias electric field having a positive wave portion and a negative wave portion having different voltages and durations. It is also preferred to superpose a DC bias component.

Referring again to FIG. 8, the electrostatic image-bearing member 101 may comprise a photosensitive drum (or a photosensitive belt) comprising a layer of a photoconductive insulating material, such as a-Se, CdS, $ZnO_2$, OPC (organic photoconductor), and a-Si (amorphous silicon). The electrostatic image-bearing member 101 may preferably comprise an a-Si photosensitive layer or OPC photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

A charging step may be performed by using a corona charger which is not in contact with the photosensitive member 1 or by using a contact charger, such as a charging roller. The contact charging as shown in FIG. 8 may preferably be used in view of efficiency of uniform charging, simplicity and a lower ozone-generating characteristic.

The charging roller 102 comprises a core metal 102*b* and an electroconductive elastic layer 102*a* surrounding a periphery of the core metal 102*b*. The charging roller 102 is pressed against the photosensitive member 101 at a prescribed pressure (pressing force) and rotated mating with the rotation of the photosensitive member 101.

The charging step using the charging roller may preferably be performed under process conditions including an applied pressure of the roller of 5–500 g/cm, an AC voltage of 0.5–5 kVpp, an AC frequency of 50–5 kHz and a DC voltage of ±0.2–±1.5 kV in the case of applying AC voltage and DC voltage in superposition; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

The toner image formed on the electrostatic image-bearing member 101 is transferred to an intermediate transfer members 5 to which a voltage (e.g., ±0.1–±5 kV) is applied. The surface of the electrostatic image-bearing member may then be cleaned by cleaning means 109 including a cleaning blade 108.

The intermediate transfer member 105 comprises a pipe-like electroconductive core metal 105*b* and a medium resistance-elastic layer 105*a* (e.g., an elastic roller) surrounding a periphery of the core metal 105*b*. The core metal 105*b* can comprise a plastic pipe coated by electroconductive plating. The medium resistance-elastic layer 105*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm. The intermediate transfer member 105 is disposed under the electrostatic image-bearing member 101 so that it has an axis (or a shaft) disposed in parallel with that of the electrostatic image-bearing member 101 and is in contact with the electrostatic image-bearing member 101. The intermediate transfer member 105 is rotated in the direction of an arrow (counterclockwise direction) at a peripheral speed identical to that of the electrostatic image-bearing member 101.

The respective color toner images are successively intermediately transferred to the peripheral surface of the intermediate transfer member 105 by an elastic field formed by applying a transfer bias to a transfer nip region between the electrostatic image-bearing member 101 and the intermediate transfer member 105 at the time of passing through the transfer nip region.

After the intermediate transfer of the respective toner image, the surface of the intermediate transfer member 105 is cleaned, as desired, by a cleaning means which can be attached to or detached from the image forming apparatus. In case where the toner image is placed on the intermediate transfer member 105, the cleaning means is detached or released from the surface of the intermediate transfer member 105 so as not to disturb the toner image.

The transfer means (e.g., a transfer roller) 107 is disposed under the intermediate transfer member 105 so that it has an axis (or a shaft) disposed in parallel with that of the intermediate transfer member 105 and is in contact with the intermediate transfer member 105. The transfer means (roller) 107 is rotated in the direction of an arrow (clockwise direction) at a peripheral speed identical to that of the intermediate transfer member 105. The transfer roller 107 may be disposed so that it is directly in contact with the intermediate transfer member 105 or in contact with the intermediate transfer member 105 via a belt, etc. The transfer roller 107 may comprise an electroconductive elastic layer 107*a* disposed on a peripheral surface of a core metal 107*b*.

The intermediate transfer member 105 and the transfer roller 107 may comprise known materials as generally used. By setting the volume resistivity of the elastic layer 105*a* of the intermediate transfer member 105 to be higher than that of the elastic layer 107*b* of the transfer roller, it is possible to alleviate a voltage applied to the transfer roller 107. As a result, a good toner image is formed on the transfer-receiving material and the transfer-receiving material is prevented from winding about the intermediate transfer member 105. The elastic layer 105*a* of the intermediate transfer member 105 may preferably have a volume resistivity at least ten times that of the elastic layer 107*b* of the transfer roller 107.

The transfer roller 107 may comprise a core metal 107*b* and an electroconductive elastic layer 107*a* comprising an elastic material having a volume resistivity of $10^6$–$10^{10}$ ohm.cm, such as polyurethane or ethylene-propylene-diene terpolymer (EPDM) containing an electroconductive substance, such as carbon, dispersed therein. A certain bias voltage (e.g., preferably of ±0.2–±10 kV) is applied to the core metal 107*b* by a constant-voltage supply.

Figure 12:
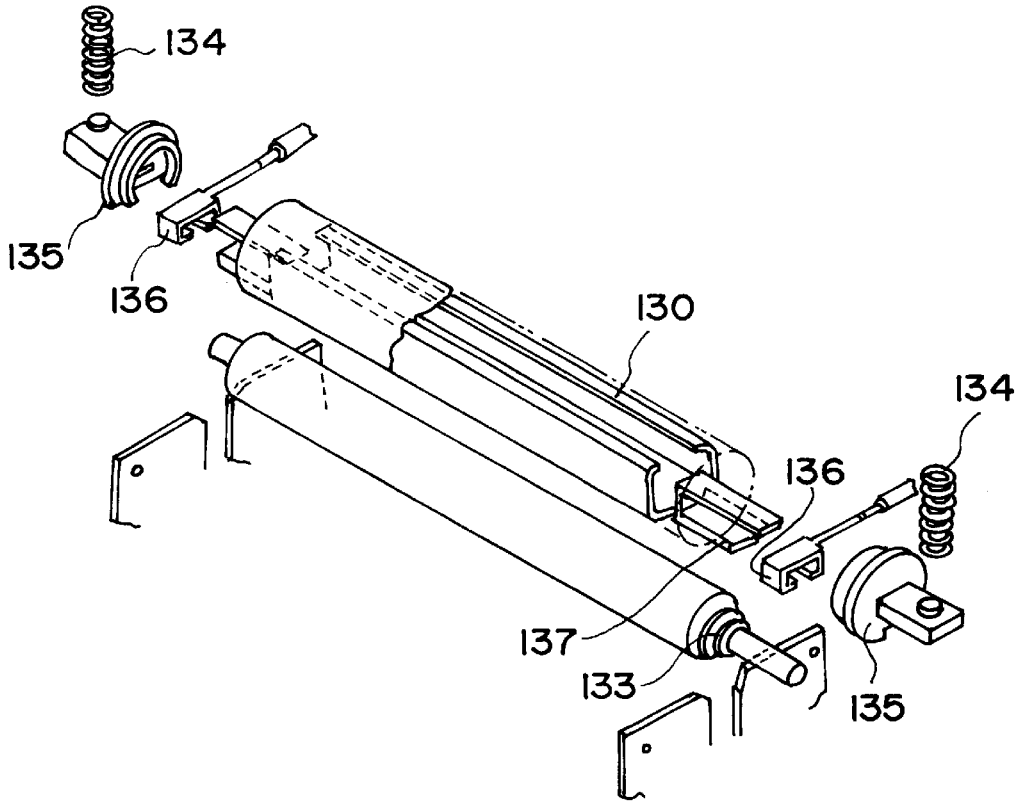
FIG. 12 is en exploded perspective view of essential parts of a fixing device usable in the invention.
Figure 13:
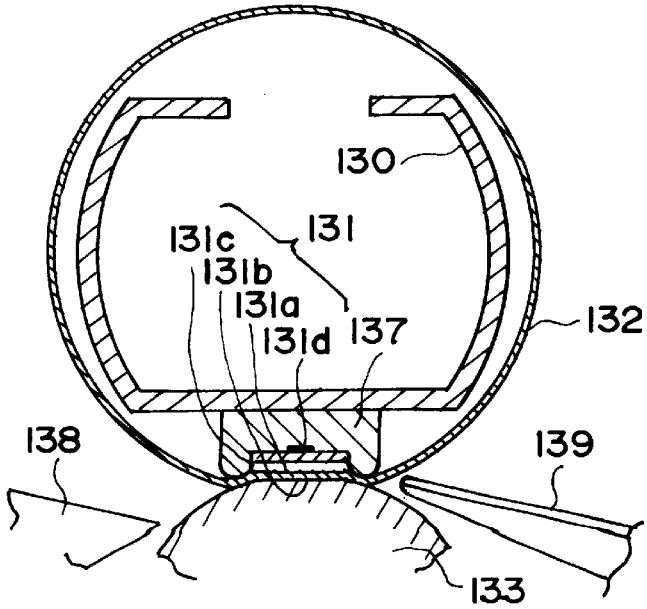
FIG. 13 is an enlarged sectional view of the fixing apparatus including a film in a non-driven state.

The transfer-receiving material 106 carrying the transferred toner image is then conveyed to heat-pressure fixation means, inclusive of a hot roller fixation device comprising basically a heating roller enclosing a heat-generating member, such as a halogen heater, and a pressure roller comprising an elastic material pressed against the heating roller, and a hot fixation device for fixation by heating via a film (as shown in FIGS. 12 and 13, wherein reference numeral 130 denotes a stay; 131, a heating member; 131a, a heater substrate; 131*b*, a heat-generating member; 131*c*, a surface protective layer; 131*d*, a temperature-detecting element; 132, a fixing film; 133, a pressing roller; 134, a coil spring; 135, a film edge-regulating member; 136, an electricity-supplying connector; 137, an electricity interrupting member; 138, an inlet guide; and 139, an outlet guide (separation guide). As the toner according to the present invention has excellent fixability and anti-offset characteristic, the toner is suitably used in combination with such a heat-pressure fixation device.

Hereinbelow, the present invention will be described more specifically based on Examples.

Preparation of Ester waxes (1)

Each ester wax was prepared in the following manner.

Into a four-necked flask equipped with a Dimroth reflux condenser and a Dean-Stark water separator, 1740 wt. parts of benzene, 1300 wt. parts of long-chain alkyl-carboxylic acid, 1200 wt. parts of long-chain alkyl alcohol and 120 wt. parts of p-toluenesulfuric acid were charged and sufficiently stirred for dissolution. Then, the system was subjected to 5 hours of refluxing and then to azeotropic distillation by opening a valve of the water separator. After the distillation, the content in the flask was sufficiently washed with sodium hydrogen carbonate and dried, followed by distilling-off of the benzene. The resultant product was recrystallized, washed and purified to obtain an ester wax.

Figure 2:
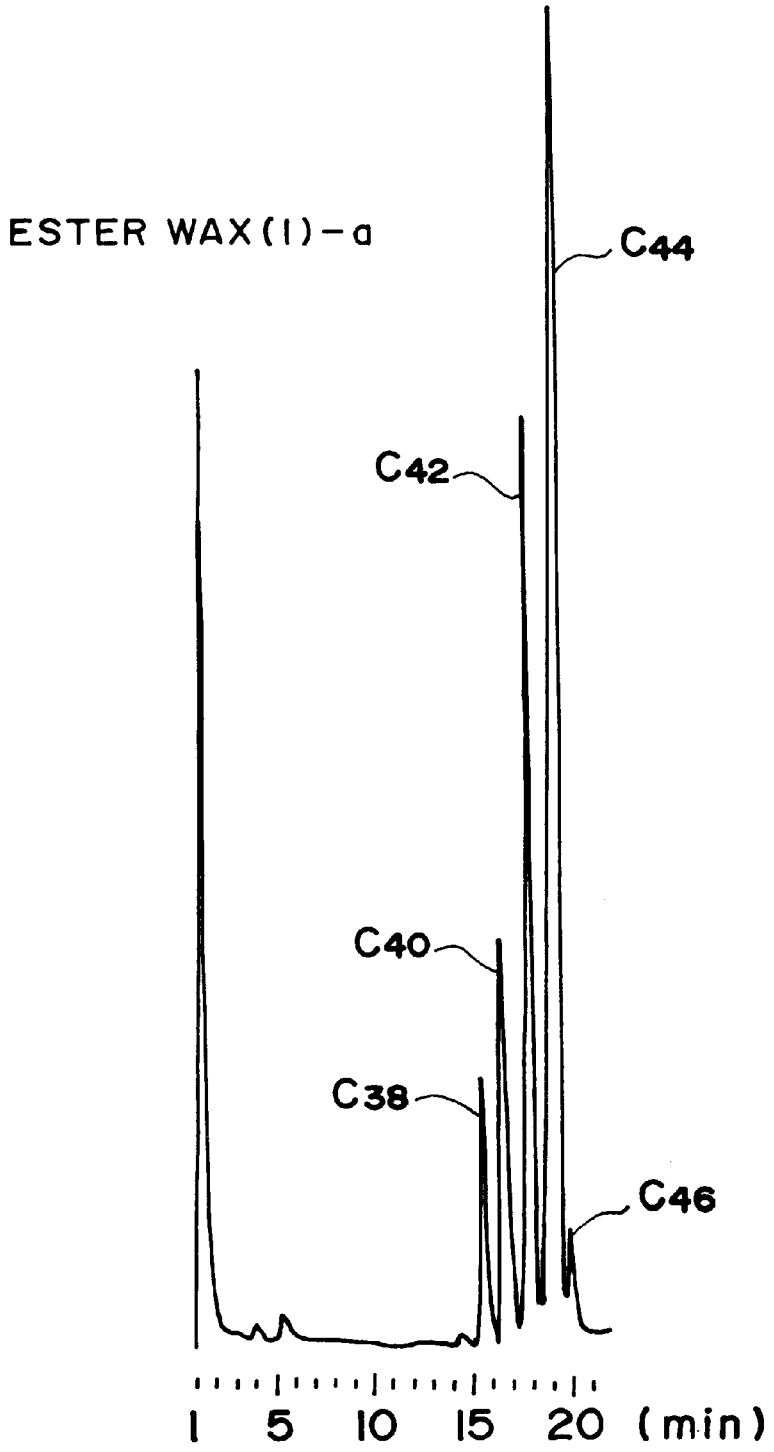
FIG. 2 is a gas chromatogram for Ester wax (1)-*a* used in Example 1.

Various types of waxes (Ester waxes (1)-*a* to (1)-*e*)) were prepared by changing the species of and relative amounts among the long-chain alkyl-carboxylic acid components and the long-chain alkyl alcohol components, respectively, while retaining the total amounts of the carboxylic acid and the alcohol, respectively, at constant. The long-chain alkyl-carboxylic acid components and the long-chain alkyl alcohol components used are shown below, and several properties of the resultant ester waxes are indicated in Table 1 appearing hereinafter wherein the ester compounds contained are represented by their total number of carbon atoms. Ester wax (1)-*a*, for example, provided a gas chromatogram as shown in FIG. 2.

| Long-chain alkyl-carboxylic acid components | |
|---|---|
| palmitic acid | $C_{16}H_{32}O_2$ |
| stearic acid | $C_{18}H_{36}O_2$ |
| arachidic acid | $C_{20}H_{40}O_2$ |
| behenic acid | $C_{22}H_{40}O_2$ |
| lignoceric acid | $C_{24}H_{48}O_2$ |
| **Long-chain alkyl alcohol components** | |
| palmityl alcohol | $C_{16}H_{34}O$ |
| stearyl alcohol | $C_{18}H_{38}O$ |
| arachidic alcohol | $C_{20}H_{42}O$ |
| behenyl alcohol | $C_{22}H_{46}O$ |

The properties and compositions of Ester waxes (1)-*a* and (1)-*e* are shown in Table 1.

Incidentally, Ester wax (1)-*e* was prepared similarly as above but by reducing the amounts of behenic acid and behenyl alcohol so that the ester compounds having any number of total carbon atoms occupied below 50 wt. % of the resultant ester wax.

TABLE 1

Ester waxes (1)

| Ester | Contents of ester compounds* (wt. %) | | | | | | | | | Melting point | | | |
|---|---|---|---|---|---|---|---|---|---|---|---|---|---|
| wax | C32 | C34 | C36 | C38 | C40 | C42 | C44 | C46 | Other | $MP_1$ (° C.) | Hardness | Mw | Mn |
| (1)-a | 0 | 0 | 0 | 0.3 | 6.1 | 16.5 | 74.9 | 0.6 | 1.6 | 74.4 | 1.8 | 630 | 500 |
| (1)-b | 0 | 0 | 0 | 5.6 | 11.0 | 21.1 | 59.8 | 1.4 | 1.1 | 73.7 | 1.3 | 630 | 490 |
| (1)-c | 1.3 | 2.5 | 9.0 | 21.0 | 63.1 | 0.6 | 0 | 0 | 2.5 | 69.9 | 1.5 | 620 | 490 |
| (1)-d | 10.1 | 29.1 | 51.0 | 5.8 | 1.7 | 0 | 0 | 0 | 2.3 | 65.6 | 1.1 | 560 | 440 |
| (1)-e | 0 | 0 | 5.2 | 5.8 | 13.8 | 27.0 | 40.0 | 2.7 | 5.5 | 72.9 | 1.3 | 590 | 480 |

*Ester compounds contained are represented by the number of total carbon atoms. For example, C44 represents ester compounds respectively having totally 44 carbon atoms.

Waxes (2)

Properties and $^{13}$C-NMR data of Waxes (2)-*a* to (2)-*c* and Comparative Waxes (2)-*d* and (2)-*e* used in Examples and Comparative Examples are inclusively shown in Table 2. Incidentally, Waxes (2)-*a* and (2)-*b* were prepared by fractionating polyalkylenes synthesized by the Arge process. Wax (2)-*c* was prepared by fractionating polyethylene synthesized in the presence of a polyfunctional monomer by the Ziegler process. Comparative Wax (2)-*d* was prepared by thermal decomposition of polyethylene. Comparative Wax (2)-*e* was prepared by oxidative decomposition of polypropylene. As shown in Table 2, Waxes (2)-*a* to (2)-*c* satisfy but Comparative Waxes (2)-*d* and (2)-*e* fail to satisfy the conditions of the wax (2) used in the present invention.

TABLE 2

| Wax | Melting point * $MP_2$ (°C.) | Waxes (2) $^{13}$C-NMR data S1/S x100 | S2/S x100 | S1<S2 or S1>S2 | number of peaks in 10–17 ppm |
|---|---|---|---|---|---|
| (2)-a | 71 | 4.0 | 8.4 | S1<S2 | 4 |
| (2)-b | 96 | 10 | 15 | S1<S2 | 3 |
| (2)-c | 52 | 1.0 | 1.5 | S1<S2 | 1 |
| (2)-d | 48 | 0 | 0.1 | S1<S2 | 1 |
| (2)-e | 136 | 14 | 6 | S1>S2 | 1 |

*: Measured as a maximum heat absorption peak temperature on a DSC curve.

EXAMPLE 1

Black Toner (A) used in this example was prepared in the following manner.

Into a four necked flask equipped with a high-speed stirring device ("TK homomixer", mfd. by Tokushu Kika Kogyo K.K.), 710 wt. parts of deionized water and 450 wt. parts of 0.1M-$Na_3PO_4$ were added. The mixture was stirred at 12000 rpm and warmed at 65° C. Further, 68 wt. parts of 1.0M-$CaCl_2$ aqueous solution was added thereto to form an aqueous dispersion medium containing $Ca_3(PO_4)_2$ (fine dispersion stabilizer with little water-solubility).

Separately, the following ingredients,

| | |
|---|---|
| Styrene | 87 wt. parts |
| n-Butyl acrylate | 13 wt. parts |
| Carbon Black ($D_{av.}$ = 37 mm, DBP absorptivity = 71 ml/100 g) | 10 wt. parts |
| Polar resin (saturated polyester (terephthalic acid/propylene oxide-modified bisphenol A, acid value = 15 mgKOH/g, peak molecular weight (GPC) = 6000)) | 5 wt. parts |
| Charge control agent (metal-containing dialkyl salicylic acid compound) | 0.5 wt. part |
| Ester wax (1)-a | 15 wt. parts |
| Wax (2)-a | 1 wt. part, |

were dispersed for 3 hours by an attritor. Into the mixture, 10 wt. parts of 2,2'-azobis(2,4-dimethylvaleronitrile) (polymerization initiator) was added, whereby a polymerizable monomer composition was prepared. The polymerizable monomer composition was added into the above aqueous dispersion medium and stirred at 12000 rpm for 15 minutes by the high-speed stirring device to disperse the polymerizable monomer composition into particles. The mixture was maintained at 65° C. and stirred at 200 rpm for 10 hours by a propeller blade stirring device to complete polymerization. After the polymerization, the resultant slurry was cooled, followed by addition of dilute hydrochloric acid to remove the dispersion stabilizer, washing and drying to recover black toner particles having weight-average particle size (D4) of 6.1 $\mu$m.

98.5 wt. parts of the black toner particles were externally blended with hydrophobic silica ($S_{BET}$=200 $m^2$/g) to obtain Black Toner (A), 5 wt. parts of which was further blended with 95 wt. parts of acrylic resin-coated ferrite to obtain Two-component Developer (A). Black Toner (A) showed shape factors SF-1=111 and SF-2=110.

EXAMPLES 2–10 AND COMPARATIVE EXAMPLES 1–11

Black Toners (B)–(U) and Two-component Developers (B)–(U) were respectively prepared in the same manner as in Example 1 except for changing the species of wax components and the amount of the carbon black respectively as shown in Table 3.

Properties of Black toners (A)–(U) are also shown in Table 3.

Comparative Example 12

Black Toner (V) and Two-component Developer (V) were prepared in the same manner as in Example 1 except for using a wax composition of 15 wt. parts of Wax (2)-*b* and 1 wt. part of Wax (2)-*d*. Black Toner (V) exhibited shape factors SF-1=114, SF-2=111.

Comparative Example 13

Black Toner (W) and Two-component Developer (W) were prepared in the sate manner as in Example 1 except for using a wax composition of 1 wt. part of Wax (2)-*b* and 1.5 wt. parts of Wax (2)-*e*. Black Toner (W) exhibited shape factors SF-1=120, SF-2=116.

TABLE 3

| Ex. & Comp. Ex. | Toner | Ester was (1) Species | Amount (A) | Wax (2) Species | Amount (B) | Amount of colorant (° C.) | A + B | B/A | B/C | SF-1 | SF-2 | $MP_2 - MP_1$ |
|---|---|---|---|---|---|---|---|---|---|---|---|---|
| Ex. 1 | A | (1)-a | 15 | (2)-a | 1 | 10 | 16 | 0.067 | 0.1 | 111 | 110 | −3.4 |
| Ex. 2 | B | (1)-a | 10 | (2)-a | 2 | 10 | 12 | 0.2 | 0.2 | 112 | 110 | −3.4 |
| Comp. Ex. 1 | C | (1)-a | 15 | (2)-a | 0.2 | 10 | 15.2 | 0.013 | 0.02 | 109 | 110 | −3.4 |
| Comp. Ex. 2 | D | (1)-a | 4 | (2)-a | 10 | 10 | 14 | 2.5 | 1 | 109 | 110 | −3.4 |
| Comp. Ex. 3 | E | (1)-a | 2 | (2)-a | 0.1 | 10 | 2.1 | 0.05 | 0.01 | 112 | 111 | −3.4 |
| Comp. Ex. 4 | F | (1)-a | 8 | (2)-a | 8 | 10 | 16 | 1 | 0.8 | 110 | 111 | −3.4 |
| Comp. Ex. 5 | G | (1)-a | 20 | (2)-a | 8 | 3.5 | 28 | 0.4 | 2.29 | 110 | 113 | −3.4 |
| Comp. | H | (1)-a | 28 | (2)-a | 13 | 10 | 41 | 0.464 | 1.3 | 118 | 115 | −3.4 |

TABLE 3-continued

| Ex. & Comp. Ex. | Toner | Ester was (1) Species | Ester was (1) Amount (A) | Wax (2) Species | Wax (2) Amount (B) | Amount of colorant (° C.) | A + B | B/A | B/C | SF-1 | SF-2 | $MP_2 - MP_1$ |
|---|---|---|---|---|---|---|---|---|---|---|---|---|
| Ex. 6 | | | | | | | | | | | | |
| Ex. 3 | I | (1)-b | 15 | (2)-a | 1 | 10 | 16 | 0.067 | 0.1 | 111 | 109 | −2.7 |
| Ex. 4 | J | (1)-c | 15 | (2)-a | 1 | 10 | 16 | 0.067 | 0.1 | 109 | 109 | 1.1 |
| Ex. 5 | K | (1)-d | 15 | (2)-a | 1 | 10 | 16 | 0.067 | 0.1 | 111 | 110 | 5.4 |
| Ex. 6 | L | (1)-a | 15 | (2)-b | 1 | 10 | 16 | 0.067 | 0.1 | 111 | 110 | 21.6 |
| Ex. 7 | M | (1)-a | 15 | (2)-c | 1 | 10 | 16 | 0.067 | 0.1 | 110 | 110 | −22.4 |
| Ex. 8 | N | (1)-a | 15 | (2)-a | 1 | 10 | 16 | 0.067 | 0.1 | 111 | 109 | −1.9 |
| Comp. Ex. 7 | O | (1)-a | 15 | (2)-d | 1 | 10 | 16 | 0.067 | 0.1 | 110 | 109 | −26.4 |
| Comp. Ex. 8 | P | (1)-a | 15 | (2)-e | 1 | 10 | 16 | 0.067 | 0.1 | 114 | 113 | 61.6 |
| Comp. Ex. 9 | Q | (1)-a | 16 | — | — | 10 | 16 | — | — | 112 | 112 | — |
| Comp. Ex. 10 | R | — | — | (2)-c | 5 | 10 | 5 | — | 0.5 | 111 | 110 | — |
| Comp. Ex. 11 | S | — | — | (2)-a | 16 | 10 | 16 | — | — | 114 | 111 | — |
| Ex. 9 | T | (1)-d | 15 | (2)-b | 1 | 10 | 16 | 0.067 | 0.1 | 112 | 109 | 30.4 |
| Ex. 10 | U | (1)-c | 15 | (2)-c | 1 | 10 | 16 | 0.067 | 0.1 | 111 | 109 | −17.9 |

Evaluation

Each of the above-prepared developers was charged in an image-forming apparatus obtained by remodeling a commercially available color copying machine ("CLC-500", mfd. by Canon K.K.) having an organization as shown in FIG. 5 and subjected to image formation in each of normal temperature/normal humidity environment (23° C./60% RH), normal temperature/normal humidity environment (23° C./5% RH) and high temperature/high humidity environment (30° C./80% RH), in which developing voltage contrasts of 300 volts, 400 volts and 200 volts, respectively, were adopted while replenishing a corresponding toner as required.

Each toner in a developer was evaluated with respect to items inclusive of: (1) Image density in normal temperature/normal humidity environment, (2) Low-temperature fixability (lowest fixable temperature ($T_{FIX.MIN}$)), (3) Transfer efficiency ($T_{EFF}$) in normal temperature/normal humidity environment, (4) Halftone image quality (Halftone) in normal temperature/normal humidity and normal temperature/low humidity environments, (5) Agglomeratability (Dagg.) in normal temperature/low humidity environment, (6) Toner chargeability before external addition of hydrophobic silica in high temperature/high humidity environment, (7) Toner chargeability after standing for a long period, (8) Charge stability and (9) Toner scattering in a continuous image formation in high temperature/high humidity environment, (10) Fog in normal temperature/normal humidity and high temperature/high humidity environments.

The evaluation methods and standards for the respective items are described below.

(1) Image Density (I.D.)

A square solid black image of 5 mm×5 mm was printed on plain paper (75 g/m$^2$) for ordinary copying machines, and the reflective density thereof is measured by a reflection densitometer ("RD918", mfd. by Macbeth Co.) as a relative density with respect to a print-out image of a white ground portion of 0.00 according to the following standard.

A: ≧1.40

B: ≧1.35 and <1.40

C: ≧1.00 and <1.35

D: <1.0

(2) Low-Temperature Fixability ($T_{FIX.MIN}$)

Non-fixed toner images were formed commercially available plain paper of 64 g/m$^2$ for copying machines ("Canon New Dry Paper", available from Canon Hambai K.K.), by using the above-mentioned copying machine and were fixed by using an external fixing device comprising a heating roller and a pressure roller both surfaced with a 10 $\mu$m-thick fluoro-ethylene polymer layer at various temperatures differing by 5° C. each in the range of 100–200° C. The fixed images were each rubbed two times with a lens cleaning paper to determine the lowest fixing temperature giving an image density lowering of 10% or below by the rubbing as a fixing initiation temperature ($T_{FIX.MIN}$).

(3) Transfer Efficiency ($T_{EFF}$)

A toner image (giving an image density of ca. 1.4) formed on a photosensitive drum and sampled by a transparent adhesive type, and the image density ($D_1$) thereof was measured by a color reflection densitometer ("X-RITE 404A", mfd. by X-Rite Co.). Then, an identical toner image was formed on the photosensitive drum and then transferred onto a transfer paper. Then, the toner image on the paper was sampled by a transparent adhesive tape, and the image density ($D_2$) thereof was similarly measured. A transfer efficiency ($T_{EFF}$) was determined according to the following equation from the measured image densities $D_1$ and $D_2$:

$$T_{EFF}\ (\%)=(D_2/D_1)\times 100.$$

(4) Halftone Image Quality (Halftone)

Copying was performed in environments of normal temperature/normal humidity (23° C./60%) and normal temperature/low humidity (23° C./5%) to provide halftone images having an image density of 0.4, of which the image quality was evaluated by observation with eyes according to the following standard:

A: Very good

B: Good

C: Showing a slight degree of roughness

D: Showing roughness

E: Noticeable roughness (5) Agglomeratability (Dagg.)

A powder tester (mfd. by Hosokawa Micron K.K.) was used. On a vibration table of the powder tester, a 400-mesh sieve, a 200-mesh sieve and a 100-mesh sieve were set in a stacked form in this order, and the vibration width was set at 0.4 mm. Then, 5 g of a sample toner was placed gently on the uppermost 100-mesh sieve, and the sieves were vibrated for 15 sec. Then, the amounts of the toner on the respective sieves were measured to calculate an agglomeratability (Dagg.) according to the following equation:

Agglomeratability (Dagg) (%)=(toner weight (g) on 100-mesh sieve/5 (g))×100+(toner weight (g) on 200-mesh sieve/5 (g))×100×3/5+(toner weight (g) on 400-mesh sieve/5 (g))×100×1/5

(6) Toner Chargeability Before External Addition of Hydrophobic Silica in a Normal Temperature/Normal Humidity Environment The triboelectric chargeability of a sample toner before addition of hydrophobic silica was measured by using the ferrite carrier used for preparation of the developer in a high temperature/high humidity environment (30° C./80%).

(7) Toner Chargeability After Standing

A toner sample before the addition of the hydrophobic silica was left standing for 4 days in a high temperature/high humidity environment, and then the triboelectric chargeability of the toner sample was measured in the same manner as in (6) above.

(8) Charge Stability During Continuous Image Formation in a High Temperature/High Humidity Environment A continuous copying test on 10,000 sheets was performed in a high temperature/high humidity environment (30° C./80% RH), and a difference in charge between those at the initial stage and the final stage of the continuous copying was measured in a % value, based on which the charge stability was evaluated according to the following standard.

A: <10% (very stable)

B: ≧10% and <20%

C: ≧20% and <30%

D: ≧30% and <40%

E: ≧40% and <50%

F: ≧50% (remarkably unstable)

(9) Toner Scattering During Continuous Copying in a High Temperature/High Humidity Environment Image quality of an image formed immediately before the end of a continuous copying test on 10,000 sheets, and the state of toner scattering was observed with eyes and evaluated according to the following standard. The level down to C may be tolerable.

A: Almost no scattering.

B: Slight toner scattering observed.

C: Some toner scattering observed.

D: Noticeable toner scattering observed.

E: Conspicuous toner scattering observed.

F: The interior of the image forming apparatus was soiled with scattered toner.

(10) Fog During Continuous Copying in Normal Temperature/Normal Humidity and High Temperature/High Humidity Environments Image quality of an image formed immediately before the end of a continuous copying test on 10,000 sheets, and the state of fog was evaluated according to the following standard. The level down to C may be tolerable.

A: Almost no fog.

B: Slight fog observed.

C: Some fog observed.

D: Noticeable fog observed.

E: Conspicuous fog observed.

F: The interior of the image forming apparatus solid with scattered toner.

The results of the evaluations are inclusively shown in Table 4.

TABLE 4

| | | | 23° C./60% | | | 23° C./5% | | | 30° C./80% Chargeability | | | | |
|---|---|---|---|---|---|---|---|---|---|---|---|---|---|
| Ex. or Comp. Ex. | Toner | $T_{FIX \cdot MIN}$ (° C.) | I.D. | Half-tone | Fog | Dagg. | $T_{EFF}$ (%) | Half tone | Initial (μC/g) | After standing | Stability | Scatter | Fog |
| Ex. 1 | A | 150 | A | A | A | 20 | 98 | A | −26.2 | −23.4 | A | A | A |
| Ex. 2 | B | 155 | A | A | A | 22 | 98 | A | −26.7 | −24.0 | A | A | A |
| Ex. 3 | I | 150 | A | A | A | 24 | 98 | A | −25.9 | −23.6 | A | A | A |
| Ex. 4 | J | 145 | A | A | A | 25 | 97 | A | −24.2 | −22.9 | B | B | B |
| Ex. 5 | K | 145 | B | A | B | 27 | 97 | B | −24.5 | −22.5 | B | B | B |
| Ex. 6 | L | 150 | A | A | A | 24 | 97 | B | −23.8 | −22.4 | B | A | B |
| Ex. 7 | M | 150 | A | B | B | 27 | 97 | B | −23.6 | −21.5 | B | B | B |
| Ex. 8 | N | 150 | A | B | B | 26 | 92 | C | −20.7 | −15.1 | C | A | B |
| Ex. 9 | T | 145 | B | B | B | 27 | 95 | C | −23.5 | −21.0 | C | B | C |
| Ex. 10 | U | 145 | B | C | B | 29 | 93 | C | −22.6 | −20.8 | C | C | C |
| Comp. Ex. 1 | C | 150 | A | A | A | 22 | 93 | C | −18.1 | −11.5 | E | D | E |
| Comp. Ex. 2 | D | 155 | B | C | C | 28 | 90 | D | −25.1 | −23.2 | D | F | D |
| Comp. Ex. 3 | E | 175 | B | B | B | 22 | 90 | D | −14.4 | −10.2 | E | E | D |
| Comp. Ex. 4 | F | 150 | B | C | C | 29 | 91 | C | −15.1 | −11.6 | F | F | F |
| Comp. Ex. 5 | G | 145 | C | D | D | 30 | 94 | C | −23.4 | −20.8 | E | D | D |
| Comp. Ex. 6 | H | 140 | D | D | D | 32 | 89 | D | −25.6 | −13.1 | F | D | E |
| Comp. Ex. 7 | O | 150 | C | D | D | 36 | 93 | E | −14.6 | −10.2 | E | E | E |
| Comp. Ex. 8 | P | 155 | C | D | D | 33 | 94 | D | −17.1 | −11.0 | D | D | E |

TABLE 4-continued

| | | | 23° C./60% | | | 23° C./5% | | | 30° C./80% Chargeability | | | | |
|---|---|---|---|---|---|---|---|---|---|---|---|---|---|
| Ex. or Comp. Ex. | Toner | $T_{FIX \cdot MIN}$ (° C.) | I.D. | Half-tone | Fog | Dagg. | $T_{EFF}$ (%) | Half tone | Initial (μC/g) | After standing | Stability | Scatter | Fog |
| Ex. 9 | Q | 150 | A | A | A | 21 | 93 | A | −15.1 | −10.1 | E | E | D |
| Comp. Ex. 10 | R | 160 | B | C | B | 27 | 89 | C | −24.5 | −22.2 | C | D | C |
| Comp. Ex. 11 | S | 155 | A | C | A | 29 | 91 | D | −23.8 | −21.4 | B | C | B |
| Comp. Ex. 12 | V | 160 | B | C | B | 30 | 91 | D | −21.5 | −18.4 | C | C | D |
| Comp. Ex. 13 | W | 175 | C | D | E | 33 | 89 | F | −25.1 | −20.6 | E | E | F |

EXAMPLE 11

A commercially available laser beam printer ("LBP-EX", mfd. by Canon K.K.) was used after remodeling its process cartridge into one as illustrated in FIG. 11 so as to be adapted for a non-magnetic mono-component developing scheme for image formation in a similar manner as in Example 1 while replenishing Black Toner (A) as required. In the normal temperature/normal humidity environment, the transfer efficiency ($T_{EFF}$) was 98%, and the halftone image quality was very good. Further, in the high temperature/high humidity environment, excellent images were formed with almost no toner scattering or fog.

Comparative Example 14

Comparative Black Toner (C) was evaluated in the same manner as in Example 11. As a result, in the normal temperature/normal humidity environment, the transfer efficiency ($T_{EFF}$) was 94% and the halftone images were accompanied with roughness. In the high temperature/high humidity environment, as the image formation was continued, toner scattering and fog became noticeable, until the images formed at the end of the continuous image formation on 10,000 sheets were accompanied with conspicuous toner scattering and remarkable fog.

What is claimed is:

1. A toner for developing an electrostatic image, comprising toner particles containing at least a binder resin, a colorant and a wax composition; wherein the wax composition comprises an ester wax (1) having a long-chain alkyl group, and a wax (2); said wax (2) showing a maximum heat-absorption peak in a range of 40–130° C. on temperature increase on a DSC (differential scanning calorimeter) curve, and giving a $^{13}$C-NMR (nuclear magnetic resonance) spectrum showing a total peak area S in a range of 0–50 ppm, a total peak area S1 in a range of 36–42 ppm, and a total peak area S2 in a range of 10–17 ppm, satisfying:

$1.0 \leqq (S1/S) \times 100 \leqq 10$, $1.5 \leqq (S2/S) \times 100 \leqq 15$, and $S_1 < S_2$, and the toner particles contain A wt. parts of the ester wax (1), B wt. parts of the wax (2) and C wt. parts of the colorant, respectively per 100 wt. parts of the binder resin, satisfying:

$3 \leqq A \leqq 30$, $0.2 \leqq B \leqq 10$, $4 \leqq A+B \leqq 40$, $0.02 \leqq B/A \leqq 0.5$, and $0.02 \leqq B/C \leqq 2$.

2. The toner according to claim 1, wherein the ester wax (1) contains ester compounds represented by a formula below:

$$R_1—COO—R_2,$$

wherein $R_1$ and $R_2$ independently denote a hydrocarbon group of 15–45 carbon atoms.

3. The toner according to claim 2, wherein the ester wax (2) contains 50–95 wt. % thereof in total of ester compounds having an identical number of total carbon atoms.

4. The toner according to claim 2, wherein the ester wax (2) contains 55–95 wt. % thereof in total of ester compounds having an identical number of total carbon atoms.

5. The toner according to claim 2, wherein the ester wax (2) contains 60–95 wt. % thereof in total of ester compounds having an identical number of total carbon atoms.

6. The toner according to claim 2, wherein the ester wax (1) contains 80–95 wt. % thereof in total of ester compounds having an identical number of total carbon atoms giving a largest content and ester compounds having numbers of total carbon atoms within a range of the identical number ±2.

7. The toner according to claim 2, wherein the ester wax (1) contains 90–95 wt. % thereof in total of ester compounds having an identical number of total carbon atoms giving a largest content and ester compounds having numbers of total carbon atoms within a range of the identical number ±2.

8. The toner according to claim 2, wherein the ester wax (1) contains 50–95 wt. % thereof in total of ester compounds having totally 44 carbon atoms.

9. The toner according to claim 1, wherein the ester wax (1) has a weight-average molecular weight (Mw) of 200–2000, and a number-average molecular weight (Mn) of 150–2000.

10. The toner according to claim 1, wherein the wax (2) provides a $^{13}$C-NMR spectrum showing a plurality of peaks in the range of 10–17 ppm.

11. The toner according to claim 1, wherein the wax has a branched chain structure represented by the following formula:

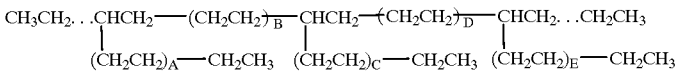

wherein A, C and E respectively denote a positive number of at least 1, and B and D denote 0 or a positive number of at least 1.

12. The toner according to claim 1, wherein the ester wax (1) and the wax (2) have maximum heat-absorption peaks at temperatures $MP_1$ (°C.) and $MP_2$ (°C.), respectively, on their DSC curves satisfying a relationship of:

$-20 \leqq (MP_2 - MP_1) \leqq 30$.

13. The toner according to claim 1, wherein the toner particles have been produced directly by polymerization in an aqueous phase of a monomer composition comprising at least a polymerizable monomer, the colorant, the wax composition and a polymerization initiator.

14. The toner according to claim 1, wherein the toner particles have shape factors SF-1 of 100–160 and SF-2 of 100–140.

15. The toner according to claim 1, wherein the toner particles have shape factors SF-1 of 100–140 and SF-2 of 100–120.

16. The toner according to claim 1, wherein the toner has a weight-average particle size of 3–8 $\mu$m.

17. The toner according to claim 1, wherein the colorant comprises carbon black.

18. An image forming method, comprising:

a charging step of charging an image-bearing member, an electrostatic image-forming step of forming an electrostatic image on the charged image-bearing member, a developing step of developing the electrostatic image with a toner carried on a developer-carrying member to form a toner image on the image-bearing member;

a transfer step of transferring the toner image on the image-bearing member onto a transfer-receiving material via or without via an intermediate transfer member, and a fixing step of fixing the toner image on the transfer-receiving material; wherein the toner comprises toner particles containing at least a binder resin, a colorant and a wax composition;

the wax composition comprises an ester wax (1) having a long-chain alkyl group, and a wax (2);

said wax (2) showing a maximum heat-absorption peak in a range of 40–130° C. on temperature increase on a DSC (differential scanning calorimeter) curve, and giving a $^{13}$C-NMR (nuclear magnetic resonance) spectrum showing a total peak area S in a range of 0–50 ppm, a total peak area S1 in a range of 36–42 ppm, and a total peak area S2 in a range of 10–17 ppm, satisfying:

$1.0 \leqq (S1/S) \times 100 \leqq 10$, $1.5 \leqq (S2/S) \times 100 \leqq 15$, and $S_1 < S_2$, and the toner particles contain A wt. parts of the ester wax (1), B wt. parts of the wax (2) and C wt. parts of the colorant, respectively per 100 wt. parts of the binder resin, satisfying:

$3 \leqq A \leqq 30$, $0.2 \leqq B \leqq 10$, $4 \leqq A+B \leqq 40$, $0.02 \leqq B/A \leqq 0.5$, and $0.02 \leqq B/C \leqq 2$.

19. The image forming method according to claim 18, wherein the ester wax (1) contains ester compounds represented by a formula below:

$R_1—COO—R_2$, wherein $R_1$ and $R_2$ independently denote a hydrocarbon group of 15–45 carbon atoms.

20. The image forming method according to claim 19, wherein the ester wax (2) contains 50–95 wt. % thereof in total of ester compounds having an identical number of total carbon atoms.

21. The image forming method according to claim 19, wherein the ester wax (2) contains 55–95 wt. % thereof in total of ester compounds having an identical number of total carbon atoms.

22. The image forming method according to claim 19, wherein the ester wax (2) contains 60–95 wt. % thereof in total of ester compounds having an identical number of total carbon atoms.

23. The image forming method according to claim 19, wherein the ester wax (1) contains 80–95 wt. % thereof in total of ester compounds having an identical number of total carbon atoms giving a largest content and ester compounds having numbers of total carbon atoms within a range of the identical number ±2.

24. The image forming method according to claim 19, wherein the ester wax (1) contains 90–95 wt. % thereof in total of ester compounds having an identical number of total carbon atoms giving a largest content and ester compounds having numbers of total carbon atoms within a range of the identical number ±2.

25. The image forming method according to claim 19, wherein the ester wax (1) contains 50–95 wt. % thereof in total of ester compounds having totally 44 carbon atoms.

26. The image forming method according to claim 18, wherein the ester wax (1) has a weight-average molecular weight (Mw) of 200–2000, and a number average molecular weight (Mn) of 150–2000.

27. The image forming method according to claim 18, wherein the wax (2) provides a $^{13}$C-NMR spectrum showing a plurality of peaks in the range of 10–17 ppm.

28. The image forming method according to claim 18, wherein the wax has a branched chain structure represented by the following formula:

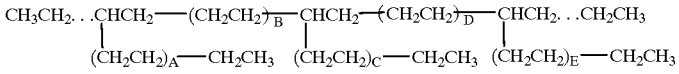

wherein A, C and E respectively denote a positive number of at least 1, and B and D denote 0 or a positive number of at least 1.

29. The image forming method according to claim 18, wherein the ester wax (1) and the wax (2) have maximum heat-absorption peaks at temperatures $MP_1$ (°C.) and $MP_2$ (°C.), respectively, on their DSC curves satisfying a relationship of:

$-20 \leqq (MP_2 - MP_1) \leqq 30$.

30. The image forming method according to claim 18, wherein the toner particles have been produced directly by polymerization in an aqueous phase of a monomer composition comprising at least a polymerizable monomer, the colorant, the wax composition and a polymerization initiator.

31. The image forming method according to claim 18, wherein the toner particles have shape factors SF-1 of 100–160 and SF-2 of 100–140.

32. The image forming method according to claim 18, wherein the toner particles have shape factors SF-1 of 100–140 and SF-2 of 100–120.

33. The image forming method according to claim 18, wherein the toner has a weight-average particle size of 3–8 μm.

34. The image forming method according to claim 18, wherein the colorant comprises carbon black.

35. The image forming method according to claim 18, wherein in the developing step, the developer-carrying member moves at a surface velocity which is 1.05–3.0 times that of the image-bearing member in a developing region, and the developer-carrying member has a surface roughness Ra of at most 1.5 μm.

36. The image forming method according to claim 18, wherein the image-bearing member is disposed with a prescribed gap from the developer-carrying member, and the electrostatic image on the image-bearing member is developed while applying an alternating electric field between the image-bearing member and the developer-carrying member.

37. The image forming method according to claim 18, wherein in the charging step, the image-bearing member is charged by applying a voltage from an external voltage source to a charging member in contact with the image-bearing member.

38. The image forming method according to claim 18, wherein in the fixing step, the toner image is fixed under heating onto the transfer-receiving material by means of a fixing device free from supply of offset-prevention liquid or a cleaner for the fixing device.

* * * * *

UNITED STATES PATENT AND TRADEMARK OFFICE

CERTIFICATE OF CORRECTION

PATENT NO. : 6,015,647

DATED : January 18, 2000

INVENTOR(S) : TOSHIYUKI UGAI, ET AL.

It is certified that error appears in the above-identified patent and that said Letters Patent is hereby corrected as shown below:

COLUMN 1:

Line 30, "become" should read --becomes--.

COLUMN 2:

Line 44, "is cause to show" should read --shows--.

COLUMN 4:

Line 51, ""wax (2)"" should read --"wax (2)")--.

COLUMN 6:

Line 62, "-coo--" should read --COO--.

COLUMN 7:

Line 11, "above-" should read --above--.

COLUMN 10:

Line 30, "spectrums" should read --spectrum--; and
Line 56, "be" should read --for--.

COLUMN 11:

Line 31, "α-monodefinic" should read--α-monoolefinic--; and
Line 63, "exhibited" should read --exhibit--.

UNITED STATES PATENT AND TRADEMARK OFFICE

CERTIFICATE OF CORRECTION

PATENT NO. : 6,015,647

DATED : January 18, 2000

INVENTOR(S) : TOSHIYUKI UGAI, ET AL.

It is certified that error appears in the above-identified patent and that said Letters Patent is hereby corrected as shown below:

COLUMN 12:

Line 28, "loose" should read--lose--; and
Line 39, "shaper" should read--shape--.

COLUMN 13:

Line 12, "an" should read --and--.

COLUMN 14:

Line 12, "advantages" should read --advantageous--.

COLUMN 15:

Line 23, "the" should read --if the--; and
Line 36, "is not dissolved" should be deleted.

COLUMN 16:

Line 6, "naphtoic" should read --naphthoic--.

COLUMN 17:

Line 23, "fine" should read --fine powder--.

COLUMN 19:

Line 2, "drum 31" should read --drum 31)--.

UNITED STATES PATENT AND TRADEMARK OFFICE

CERTIFICATE OF CORRECTION

PATENT NO. : 6,015,647

DATED : January 18, 2000

INVENTOR(S) : TOSHIYUKI UGAI, ET AL.

It is certified that error appears in the above-identified patent and that said Letters Patent is hereby corrected as shown below:

COLUMN 22:

Line 42, "such" should read --of such--; and
Line 67, "become" should read --becomes--.

COLUMN 23:

Line 26, "better" should read --more--; and
Line 63, "forth" should be deleted.

COLUMN 26:

Line 6, "member 5" should read --member 105--.

COLUMN 27:

Line 23, "(as" should read --as--.

COLUMN 28:

Line 30, "(1)-a and" should read --(1)-a to--.

COLUMN 30:

Line 45, "sate" should read --same--; and
Table 3, "was (1)" should read --wax (1)--.

COLUMN 31:

Table 3, "was (1)" should read --wax (1)--.

UNITED STATES PATENT AND TRADEMARK OFFICE

CERTIFICATE OF CORRECTION

PATENT NO. : 6,015,647

DATED : January 18, 2000

INVENTOR(S) : TOSHIYUKI UGAI, ET AL.

It is certified that error appears in the above-identified patent and that said Letters Patent is hereby corrected as shown below:

COLUMN 31: (cont.)

Line 31, "temperature/normal" should --same--; and
Line 66, "formed" should --formed on--.

COLUMN 34:

Line 31, "solid" should --soiled--; and
Table 4, "Half" should --Half---.

COLUMN 35:

Table 4, "Half" should --Half---.

Signed and Sealed this

Tenth Day of April, 2001

*Attest:*

Nicholas P. Godici

NICHOLAS P. GODICI

*Attesting Officer*

*Acting Director of the United States Patent and Trademark Office*